US009288583B2

(12) United States Patent
Nakano et al.

(10) Patent No.: US 9,288,583 B2
(45) Date of Patent: Mar. 15, 2016

(54) SPEAKER

(71) Applicant: TOKAI RUBBER INDUSTRIES, LTD., Aichi-ken (KR)

(72) Inventors: Katsuhiko Nakano, Aichi-ken (KR); Mitsuyoshi Kondo, Aichi-ken (JP)

(73) Assignee: SUMITOMO RIKO COMPANY LIMITED, Aichi (JP)

( * ) Notice: Subject to any disclaimer, the term of this patent is extended or adjusted under 35 U.S.C. 154(b) by 0 days.

(21) Appl. No.: 14/325,831

(22) Filed: Jul. 8, 2014

(65) Prior Publication Data

US 2014/0321675 A1 Oct. 30, 2014

Related U.S. Application Data

(63) Continuation of application No. PCT/JP2012/078858, filed on Nov. 7, 2012.

(30) Foreign Application Priority Data

Mar. 30, 2012 (JP) ..... 2012-082437

(51) Int. Cl.
*H04R 25/00* (2006.01)
*H04R 19/02* (2006.01)
*H04R 7/06* (2006.01)

(52) U.S. Cl.
CPC . *H04R 19/02* (2013.01); *H04R 7/06* (2013.01)

(58) Field of Classification Search
CPC ..... H04R 19/02; H04R 7/06
See application file for complete search history.

(56) References Cited

U.S. PATENT DOCUMENTS 3,345,469 A * 10/1967 Rod ..... H04R 19/02 381/191
3,544,733 A * 12/1970 Reylek ..... H04R 19/00 29/594

(Continued)

FOREIGN PATENT DOCUMENTS

JP 48-029420 4/1973
JP 50-110235 9/1975

(Continued)

OTHER PUBLICATIONS

International Search Report (ISR) in International Patent Application No. PCT/JP2012/078858, dated Jan. 29, 2013.

(Continued)

*Primary Examiner* — Curtis Kuntz
*Assistant Examiner* — Ryan Robinson
(74) *Attorney, Agent, or Firm* — Greenblum & Bernstein, P.L.C.

(57) ABSTRACT

A speaker includes: a pair of front-side and back-side vibration portions each having a dielectric layer having insulating properties and made of an elastomer or resin, a front-side electrode layer placed on a front side of the dielectric layer and having conductive properties, and a back-side electrode layer placed on a back side of the dielectric layer and having conductive properties; an interposed member placed between the pair of vibration portions so that the front-side vibration portion protrudes toward a front side and the back-side vibration portion protrudes toward a back side; and a circuit section that transmits signal waves based on sound to be reproduced to the pair of vibration portions so that the signal waves transmitted to the pair of vibration portions have opposite phases to each other, and drives the pair of vibration portions.

20 Claims, 13 Drawing Sheets

(56) References Cited

U.S. PATENT DOCUMENTS

| | | | | |
|---|---|---|---|---|
| 3,947,644 | A * | 3/1976 | Uchikawa | B06B 1/0688 310/332 |
| 4,186,323 | A * | 1/1980 | Cragg | H04R 17/005 310/324 |
| 6,343,129 | B1 * | 1/2002 | Pelrine | F04B 35/045 381/116 |
| 6,490,360 | B2 * | 12/2002 | Corsaro | H04R 17/005 310/311 |
| 7,895,728 | B2 * | 3/2011 | Benslimane | H01L 41/0836 29/595 |
| 8,284,967 | B2 | 10/2012 | Yang et al. | |
| 8,385,586 | B2 * | 2/2013 | Liou | H04R 19/00 381/191 |
| 8,600,083 | B2 * | 12/2013 | Chiang | H04R 19/013 381/174 |
| 2010/0278363 | A1 | 11/2010 | Yang et al. | |
| 2014/0003634 | A1 * | 1/2014 | Ito | C08L 101/10 381/190 |

FOREIGN PATENT DOCUMENTS

| | | |
|---|---|---|
| JP | 50-110238 | 9/1975 |
| JP | 54-008296 | 4/1979 |
| JP | 2008-227832 | 9/2008 |
| JP | 2009-272853 | 11/2009 |
| JP | 2009-272978 | 11/2009 |
| JP | 2009-540732 | 11/2009 |
| JP | 2011-072112 | 4/2011 |
| WO | 2008/002049 | 1/2008 |

OTHER PUBLICATIONS

International Preliminary Report on Patentability (IPRP) for International Patent Application No. PCT/JP2012/078858, dated Oct. 1, 2014, together with an English language translation thereof.

* cited by examiner

SPEAKER

CLAIM FOR PRIORITY

This application is a Continuation of PCT/JP2012/078858 filed Nov. 7, 2012, and claims the priority benefit of Japanese application 2012-082437, filed Mar. 30, 2012, the contents of which is expressly incorporated by reference herein in its entirety.

TECHNICAL FIELD

The present invention relates to electrostatic speakers that reproduce sound by vibrating a vibration portion based on a change in electrostatic attraction.

BACKGROUND ART

Patent Documents 1 to 3 disclose electrostatic speakers. The electrostatic speakers include a vibration portion. The vibration portion includes a dielectric layer and a pair of electrode layers. The pair of electrode layers are placed on the front and back surfaces of the dielectric layer.

If a bias voltage having a signal wave based on sound being superimposed thereon is applied to the pair of electrode layers, the voltage between the pair of electrode layers varies according to a change in the sound. Electrostatic attraction between the pair of electrode layers changes accordingly. As the electrostatic attraction changes, the dielectric layer is deformed, and the vibration portion vibrates. The electrostatic speaker reproduces the sound by using this vibration.

RELATED ART DOCUMENTS

Patent Documents

Patent Document 1: Japanese Patent Application Publication No. 2008-227832 (JP 2008-227832 A)

Patent Document 2: Japanese Patent Application Publication No. 2009-540732 (JP 2009-540732 A)

Patent Document 3: Japanese Patent Application Publication No. 2009-272853 (JP 2009-272853 A)

SUMMARY OF THE INVENTION

Problem to be Solved by the Invention

The inventor of the present application conducted studies to improve low-frequency characteristics of electrostatic speakers. Specifically, the inventor conducted studies (a) to increase vibration amplitude of the dielectric layer, namely the vibration portion and (b) to increase surface area of the dielectric layer, namely the vibration portion.

In the case of (a), the vibration amplitude of the vibration portion can be increased by increasing mass of the vibration portion (e.g., by increasing the thickness of the dielectric layer). However, a large voltage need be applied to the vibration portion in order to vibrate the vibration portion having large mass. This complicates the circuit configuration of the speakers.

In the case of (b), the surface area of the vibration portion can be increased by increasing the size of the vibration portion. However, increasing the size of the vibration portion increases the size of the speaker.

A speaker according to the present invention was completed in view of the above problems. It is an object of the present invention to provide a speaker that requires a low applied voltage, that can be reduced in size, and that can be improved in low-frequency characteristics.

Means for Solving the Problem (1) In order to solve the above problems, a speaker according to the present invention is characterized by including: a pair of front-side and back-side vibration portions each having a dielectric layer having insulating properties and made of an elastomer or resin, a front-side electrode layer placed on a front side of the dielectric layer and having conductive properties, and a back-side electrode layer placed on a back side of the dielectric layer and having conductive properties; an interposed member placed between the pair of vibration portions so that the front-side vibration portion protrudes toward a front side and the back-side vibration portion protrudes toward a back side; and a circuit section that transmits signal waves based on sound to be reproduced to the pair of vibration portions so that the signal waves transmitted to the pair of vibration portions have opposite phases to each other, and drives the pair of vibration portions.

As used herein, the expression "made of an elastomer or resin" means that a base material of the dielectric layer is made of an elastomer or resin. That is, the dielectric layer may contain other components such as an additive in addition to the elastomer or resin. The "elastomer" includes rubber and thermoplastic elastomer.

The speaker of the present invention is an electrostatic speaker. If the sound to be reproduced is input to the speaker, a voltage between the front-side electrode layer and the back-side electrode layer changes. Thus, electrostatic attraction between the front-side electrode layer and the back-side electrode layer changes accordingly, and the dielectric layer therefore expands or contracts in a front-back direction. When the dielectric layer expands in the front-back direction, the dielectric layer contracts in a surface direction (direction crossing the front-back direction). On the contrary, when the dielectric layer contracts in the front-back direction, the dielectric layer expands in the surface direction. By using such deformation of the dielectric layer, the speaker of the present invention vibrates the vibration portion to reproduce the sound.

The speaker of the present invention includes the pair of vibration portions, the interposed member, and the circuit section. The interposed member is interposed between the pair of vibration portions. The circuit section transmits the signal waves based on the sound to the pair of vibration portions so that the signal waves transmitted to the pair of vibration portions have opposite phases to each other. The pair of vibration portions therefore operate in opposite directions to each other. For example, in the case where the back-side vibration portion contracts in the surface direction, the front-side vibration portion expands in the surface direction. On the contrary, in the case where the front-side vibration portion contracts in the surface direction, the back-side vibration portion expands in the surface direction.

According to the speaker of the present invention, a load can be transmitted between the pair of vibration portions via the interposed member. This can increase vibration in the front-back direction of the pair of vibration portions, and thus can increase vibration amplitude of the pair of vibration portions. Accordingly, low-frequency characteristics of the speaker can be improved despite of a low applied voltage to the pair of vibration portions. For example, a sound pressure in a low frequency region can be increased. Moreover, a frequency region that can be reproduced can be extended to low frequencies. The speaker of the present invention can be reduced in size despite of its high low-frequency characteristics.

(1-1) Preferably, in the above configuration (1), the front-side electrode layer and the back-side electrode layer are formed by coating the dielectric layer with an electrode material as a material of the front-side electrode layer and the back-side electrode layer. According to this configuration, formation of the front-side electrode layer and the back-side electrode layer and arrangement of the front-side electrode layer and the back-side electrode layer can be performed simultaneously.

(1-2) Preferably, in the above configuration (1), the front-side electrode layer and the back-side electrode layer are bonded to the dielectric layer. According to this configuration, the front-side electrode layer and the back-side electrode layer can be firmly fixed to the dielectric layer.

(2) Preferably, in the above configuration (1), the interposed member has a larger spring constant in a front-back direction than in a surface direction. According to this configuration, the interposed member is less likely to expand and contract in the front-back direction. This can reduce transmission loss of the load between the pair of vibration portions. According to this configuration, the interposed member tends to be deformed in the surface direction. Therefore, the interposed member tends to expand and contract according to expansion and contraction in the surface direction of the vibration portions.

(3) Preferably, in the above configuration (1) or (2), the circuit section superimposes bias voltages of a same polarity on the signal waves with the opposite phases to each other, and apply the respective resultant voltages to the front-side electrode layer of the front-side vibration portion and the back-side electrode layer of the back-side vibration portion, and the back-side electrode layer of the front-side vibration portion and the front-side electrode layer of the back-side vibration portion are grounded. According to this configuration, the pair of vibration portions can be easily operated in opposite directions.

(4) Preferably, in any one of the above configurations (1) to (3), the vibration portion has a front-side shield layer placed on a front side of the front-side electrode layer, having insulating properties, and made of an elastomer, and a back-side shield layer placed on a back side of the back-side electrode layer, having insulating properties, and made of an elastomer. According to this configuration, insulating properties of the vibration portions can be easily ensured.

(5) Preferably, in the above configuration (4), the vibration portion is a film assembly in which the front-side shield layer, the front-side electrode layer, the dielectric layer, the back-side electrode layer, and the back-side shield layer are stacked from the front side toward the back side. According to this configuration, the front-side shield layer, the front-side electrode layer, the dielectric layer, the back-side electrode layer, and the back-side shield layer are held together as an integral part. This facilitates assembly work of the speaker.

(6) Preferably, in the above configuration (5), the speaker further includes: a front-side frame member placed on a front side of the front-side film assembly, and a back-side frame member placed on a back side of the back-side film assembly, wherein the front-side film assembly and the back-side film assembly are held and fixed in the front-back direction by the front-side frame member and the back-side frame member.

Each of the pair of film assemblies has a fixed portion (portion fixed to the front-side frame member and the back-side frame member) and an in-frame portion (portion placed inside the frame of the front-side frame member and the back-side frame member). According to this configuration, a hinge fulcrum (fulcrum of vibration of the in-frame portion) can be placed at the boundary between the fixed portion and the in-frame portion.

(6-1) Preferably, in the configuration (6), each of the pair of film assemblies has the fixed portion fixed to the front-side frame member and the back-side frame member and the in-frame portion placed inside the frame of the front-side frame member and the back-side frame member, the hinge fulcrum is placed at the boundary between the fixed portion and the in-frame portion, the interposed member is placed inside the frame of the front-side frame member and the back-side frame member, and an edge member that is more rigid than the interposed member is placed between the hinge fulcrum and the interposed member. According to this configuration, the film assemblies can be greatly vibrated with respect to the hinge fulcrum. This can increase the vibration amplitude of the pair of film assemblies.

(7) Preferably, in the above configuration (6), each of the front-side frame member and the back-side frame member has a pair of opposite sides facing each other in the surface direction. According to this configuration, the film assemblies can be greatly vibrated with respect to the hinge fulcrum. This can increase the vibration amplitude of the pair of film assemblies.

(8) Preferably, in any one of the above configurations (1) to (7), the interposed member has a plurality of interposed bodies stacked in the front-back direction, and at least two of the plurality of interposed bodies have different spring constants from each other in the front-back direction.

According to this configuration, the entire interposed member can be pressed against the vibration portions by an elastic force of the interposed body having a smaller spring constant in the front-back direction. The entire vibration portions each can therefore be vibrated uniformly. Accordingly, the phase of the vibration wave is less likely to vary across each of the vibration portions. According to this configuration, transmission loss of the load between the pair of vibration portions can be reduced by an elastic force of the interposed body having a larger spring constant in the front-back direction.

(9) Preferably, in the above configuration (8), the plurality of interposed bodies are an inner interposed body, and a pair of outer interposed bodies stacked on both sides of the inner interposed body in the front-back direction and contacting the pair of front-side and back-side vibration portions, and the inner interposed body has a larger spring constant in the front-back direction than the outer interposed bodies.

According to this configuration, the transmission loss of the load between the pair of vibration portions can be reduced by the inner interposed body. According to this configuration, the entire interposed member can be pressed against the vibration portions by the outer interposed bodies.

(9-1) Preferably, in the above configuration (9), the inner interposed body is made of a foam material (e.g., polystyrene foam), and the outer interposed bodies are made of a sponge material (e.g., polyurethane foam).

According to this configuration, the interposed member can be reduced in weight. The outer interposed bodies made of the sponge material are porous. Each of the outer interposed bodies therefore has a small contact area with the vibration portion. According to this configuration, friction resistance between the vibration portion and the outer interposed body is reduced. Accordingly, expansion and contraction in the surface direction of the vibration portion are less likely to be inhibited by the outer interposed body.

(10) Preferably, in the above configuration (8), the plurality of interposed bodies are an inner interposed body, and a pair of outer interposed bodies stacked on both sides of the inner interposed body in the front-back direction and contacting the pair of front-side and back-side vibration portions, and the inner interposed body has a smaller spring constant in the front-back direction than the outer interposed bodies.

According to this configuration, the transmission loss of the load between the pair of vibration portions can be reduced by the outer interposed bodies. According to this configuration, the entire interposed member can be pressed against the vibration portions by the inner interposed body.

(10-1) Preferably, in the above configuration (10), the inner interposed body is made of a sponge material (e.g., polyurethane foam), and the outer interposed bodies are made of a foam material (e.g., polystyrene foam). According to this configuration, the interposed member can be reduced in weight.

(10-2) Preferably, in the above configuration (10), a lubricant (e.g., grease) is applied to the outer surfaces of the outer interposed bodies. According to this configuration, friction resistance between the vibration portion and the outer interposed body is reduced. Accordingly, expansion and contraction in the surface direction of the vibration portion are less likely to be inhibited by the outer interposed body.

Effects of the Invention

According to the present invention, a speaker can be provided which requires a low applied voltage, can be reduced in size, and can be improved in low-frequency characteristics.

DESCRIPTION OF THE REFERENCE NUMERALS

1: Speaker

2: Film Assembly, 20: Dielectric Layer, 21: Front-Side Electrode Layer, 22: Back-Side Electrode Layer, 23: Front-Side Shield Layer, 24: Back-Side Shield Layer

3: Film Assembly, 30: Dielectric Layer, 31: Front-Side Electrode Layer, 32: Back-Side Electrode Layer, 33: Front-Side Shield Layer, 34: Back-Side Shield Layer

4: Interposed Member, 40: Hole, 41: Edge Member, 42: Inner Interposed Body, 43: Outer Interposed Body

5: Circuit Section, 50*a*: AC Power Supply, 50*b*: AC Power Supply, 51: DC Bias Power Supply, 53: Switch

6: Front-Side Frame Member, 60L: Opposite Side, 60R: Opposite Side, 61D: Opposite Side, 61U: Opposite Side

7: Back-Side Frame Member, 70L: Opposite Side, 70R: Opposite Side, 71D: Opposite Side, 71U: Opposite Side

80: First Outer Electrode Layer Terminal, 81: Nut, 82: Second Outer Electrode Layer Terminal, 83: Nut, 84: Inner Electrode Layer Terminal, 85: Nut, 86: Bolt, 87: Nut, H: Hinge Fulcrum, K1 to K3: Spring Constant, P1: Fixed Portion, P2: In-Frame Portion, Vp: Bias Voltage

MODES FOR CARRYING OUT THE INVENTION

Embodiments of a speaker according to the present invention will be described below.

First Embodiment

Overall Configuration of Speaker

First, the overall configuration of a speaker of the present embodiment will be described. In the figures described below, front corresponds to the "front side" of the present invention, and rear corresponds to the "back side" of the present invention. The longitudinal direction (the direction in which a front film assembly, an interposed member, and a rear film assembly are stacked, as described below) corresponds to the "front-back direction" of the present invention, The vertical and horizontal directions (the directions perpendicular to the longitudinal direction) correspond to the "surface direction" of the present invention.

Figure 1:
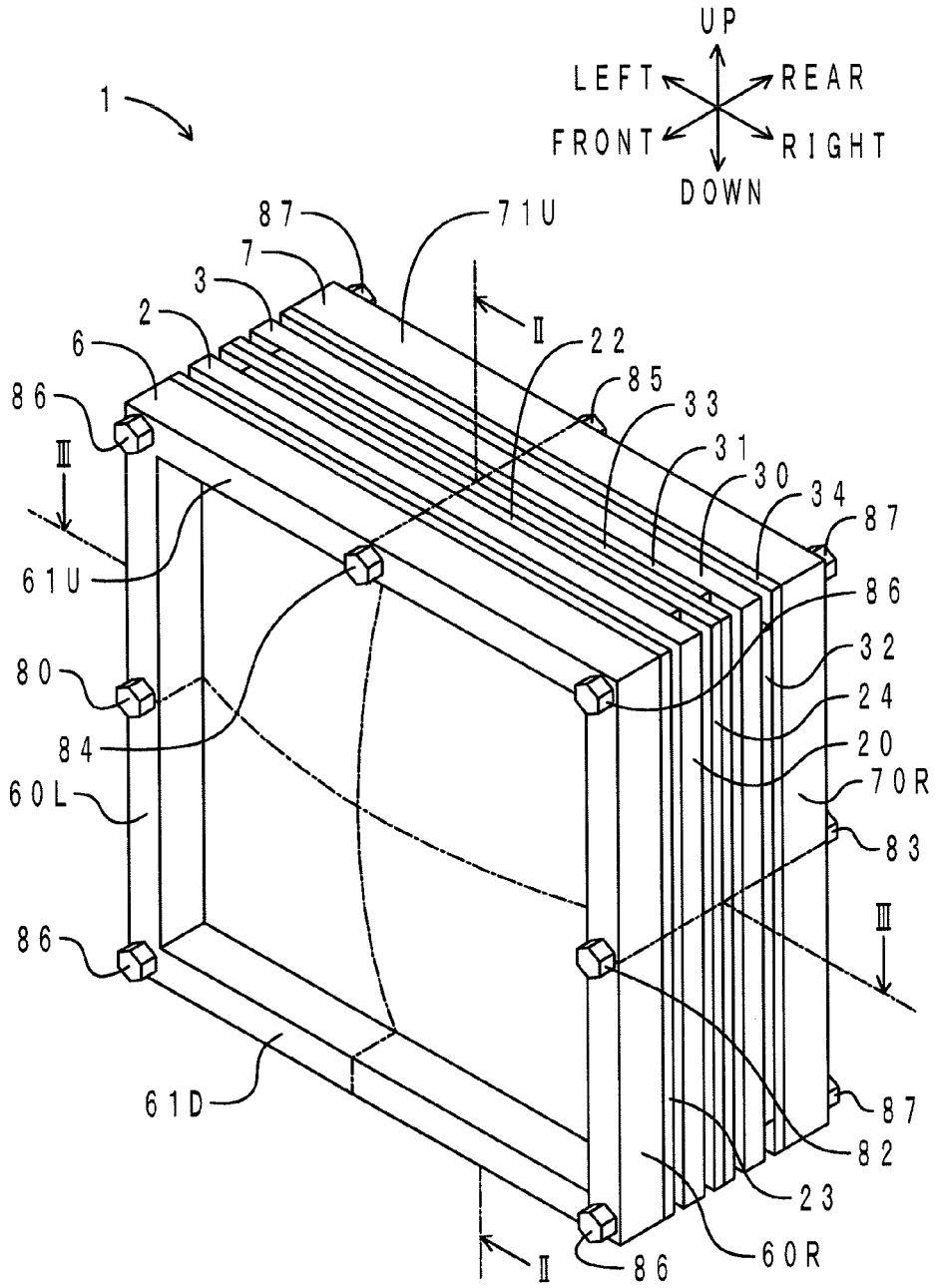
FIG. 1 is a perspective view of a speaker of a first embodiment.
Figure 2:
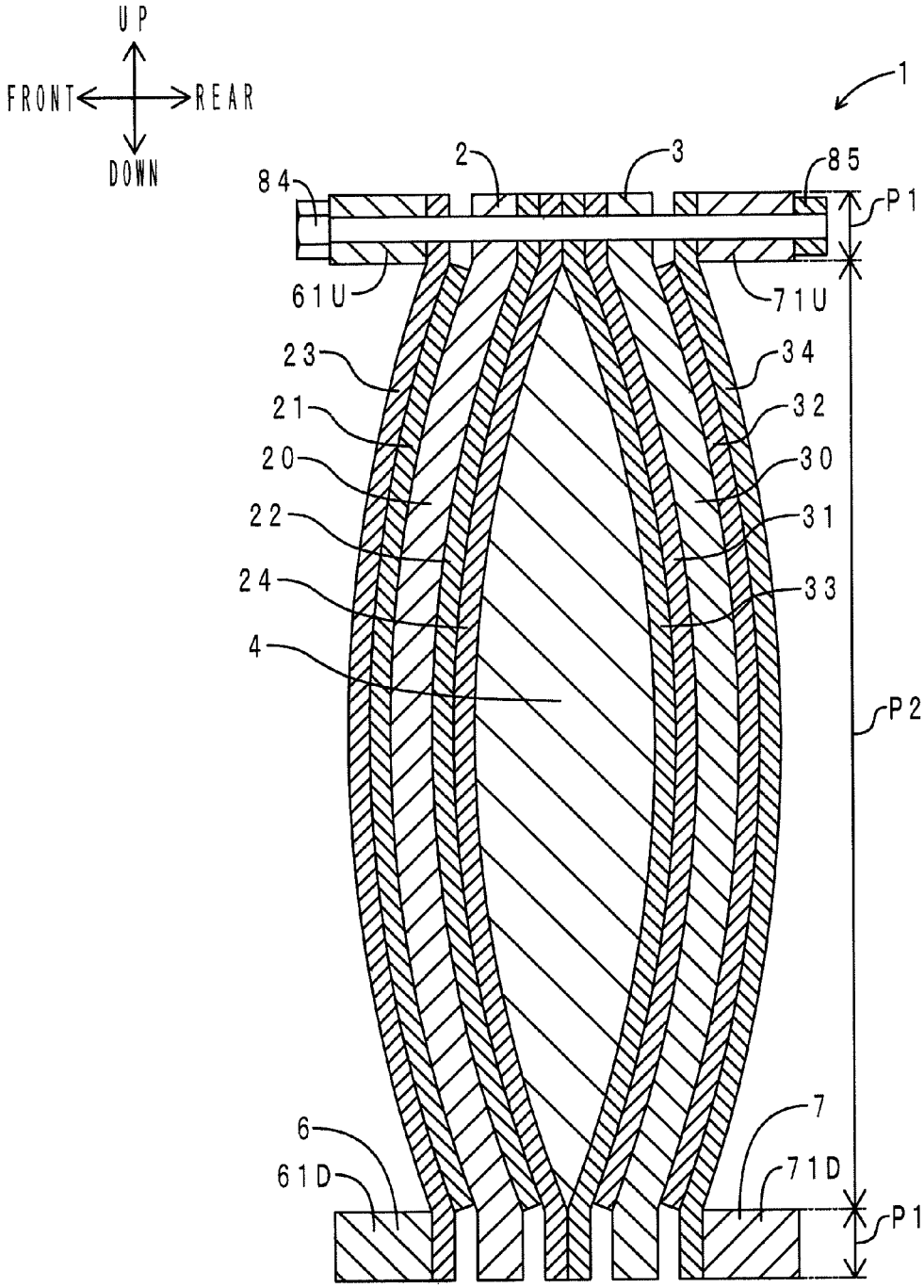
FIG. 2 is a sectional view taken along the direction II-II in FIG. 1.
Figure 3:
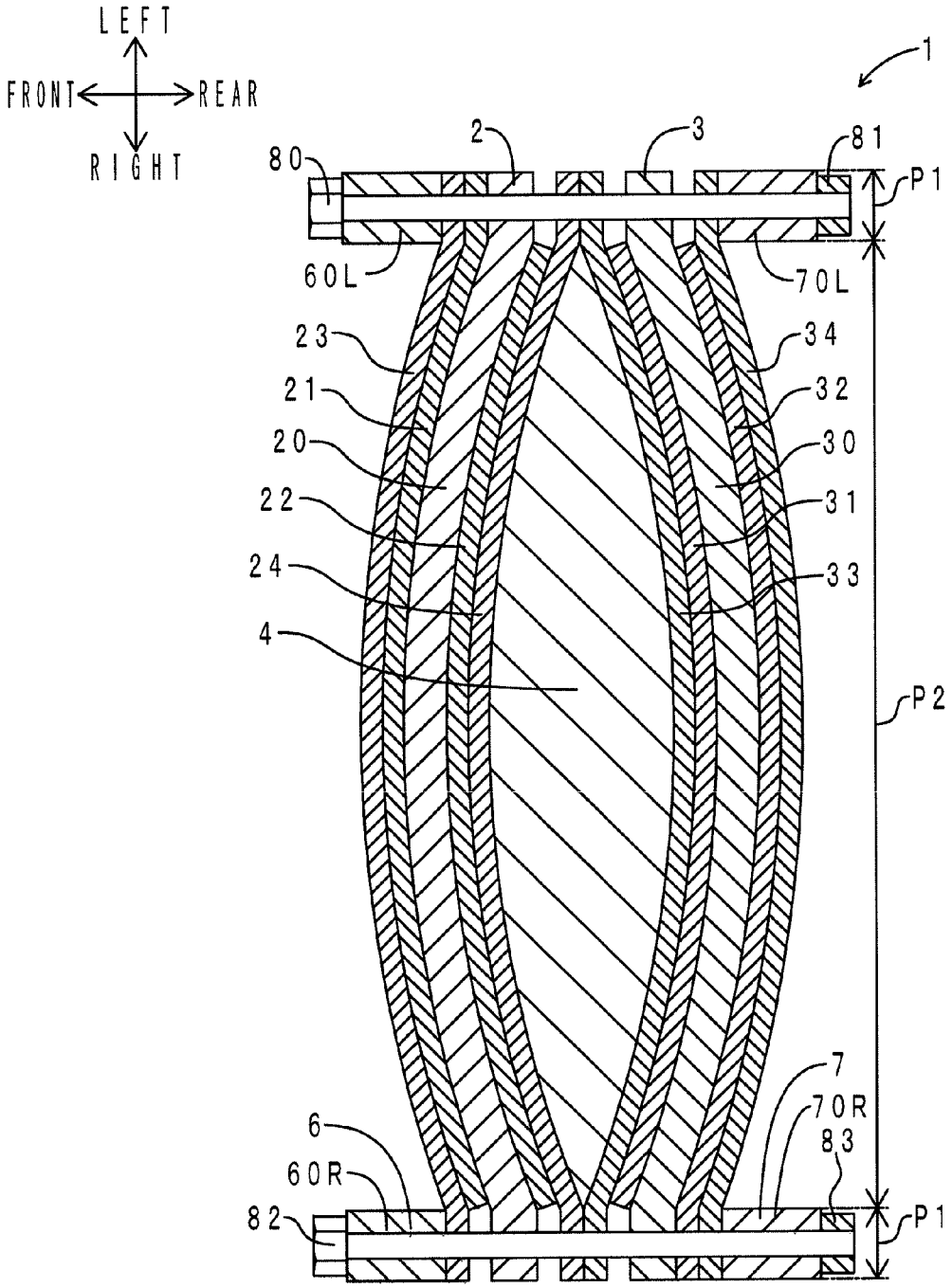
FIG. 3 is a sectional view taken along the direction III-III in FIG. 1.
Figure 4:
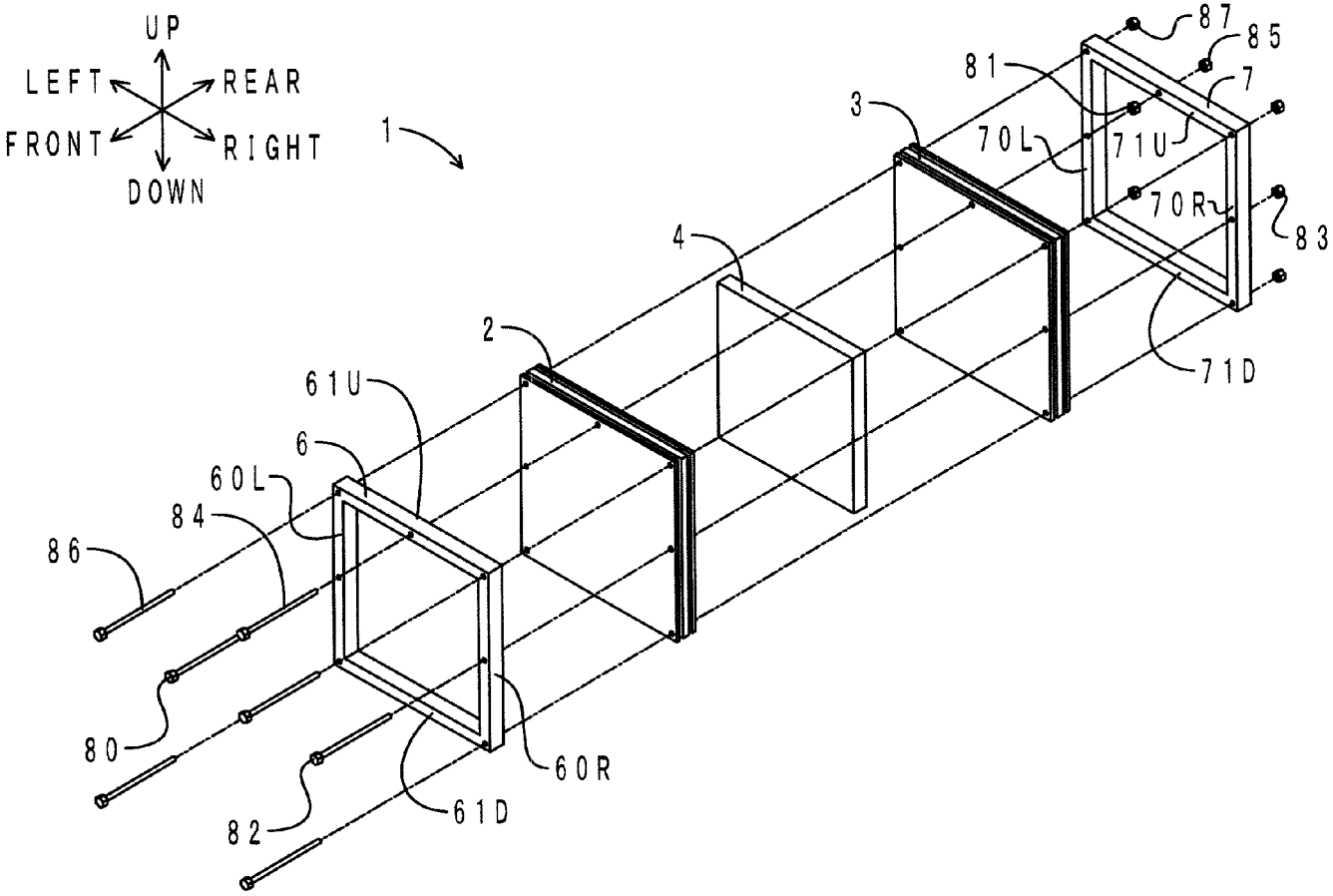
FIG. 4 is an exploded perspective view of the speaker.

FIG. 1 is a perspective view of the speaker of the present embodiment. FIG. 2 is a sectional view taken along the direction II-II in FIG. 1. FIG. 3 shows a sectional view taken along the direction III-III in FIG. 1. FIG. 4 is an exploded perspective view of the speaker.

As shown in FIGS. 1 to 4, a speaker 1 of the present embodiment includes a front film assembly 2, a rear film assembly 3, an interposed member 4, a circuit section (not shown), a front-side frame member 6, a back-side frame member 7, a first outer electrode layer terminal 80, a nut 81, a second outer electrode layer terminal 82, a nut 83, an inner electrode layer terminal 84, a nut 85, four bolts 86, and four nuts 87.

The front-side frame member 6 is made of a resin and in the form of a rectangular frame. The front-side frame member 6 has opposite sides 60L, 60R, 61U, 61D. Each of the opposite sides 60L, 60R, 61U, 61D is linear. The opposite sides 60L, 60R face each other in the lateral direction. The opposite sides 61U, 61D face each other in the vertical direction.

As described below, the front film assembly 2 is in the form of a quadrilateral film having a five-layer structure. The film assembly 2 is placed behind the front-side frame member 6. The film assembly 2 protrudes forward due to the interposed member 4, described below. That is, the film assembly 2 has a convex shape that bulges forward.

The interposed member 4 is made of polyurethane foam and in the form of a quadrilateral plate. The interposed member 4 is placed behind the film assembly 2. The interposed member 4 is placed such that it is compressed in the longitudinal direction. The interposed member 4 therefore elastically presses the film assembly 2 forward and elastically presses the film assembly 3 rearward.

As described below, the rear film assembly 3 is in the form of a quadrilateral film having a five-layer structure. The film assembly 3 is placed behind the interposed member 4. The film assembly 3 protrudes rearward due to the interposed member 4. That is, the film assembly 3 has a convex shape that bulges rearward.

The configuration of the back-side frame member 7 is similar to that of the front-side frame member 6. That is, the back-side frame member 7 has four opposite sides 70L, 70R, 71U, 71D. The back-side frame member 7 is placed behind the film assembly 3.

In the speaker 1, the front-side frame member 6, the film assembly 2, the interposed member 4, the film assembly 3, the back-side frame member 7 are thus arranged in this order from front to rear (hereinafter these members are collectively referred to as the "stack").

The four bolts 86 are disposed at four corners of the stack. The four bolts 86 extend through the stack in the longitudinal direction. The nuts 87 are tightened on the rear ends of the respective four bolts 86. The members of the stack are held together as an integrated part by the four bolts 86 and the four nuts 87.

The first outer electrode layer terminal 80 is made of a metal and is in the shape of a bolt. The first outer electrode layer terminal 80 is placed in the middle of the left side of the stack in the vertical direction. The first outer electrode layer terminal 80 extends through the stack in the longitudinal direction. The nut 81 is tightened on the rear end of the first outer electrode layer terminal 80.

The second outer electrode layer terminal 82 is made of a metal and is in the shape of a bolt. The second outer electrode layer terminal 82 is placed in the middle of the right side of the stack in the vertical direction. The second outer electrode layer terminal 82 extends through the stack in the longitudinal direction. The nut 83 is tightened on the rear end of the second outer electrode layer terminal 82.

The inner electrode layer terminal 84 is made of a metal and in the form of a bolt. The inner electrode layer terminal 84 is placed in the middle of the upper side of the stack in the lateral direction. The inner electrode layer terminal 84 extends through the stack in the longitudinal direction. The nut 85 is tightened on the rear end of the inner electrode layer terminal 84.

The four sides of the film assemblies 2, 3 are held and fixed in the longitudinal direction by the front-side frame member 6 and the back-side frame member 7, as viewed from the front or rear. The interposed member 4 is accommodated in the frame of the front-side frame member 6 and the back-side frame member 7, as viewed from the front or rear.

Configuration of Front Film Assembly 2

Figure 5:
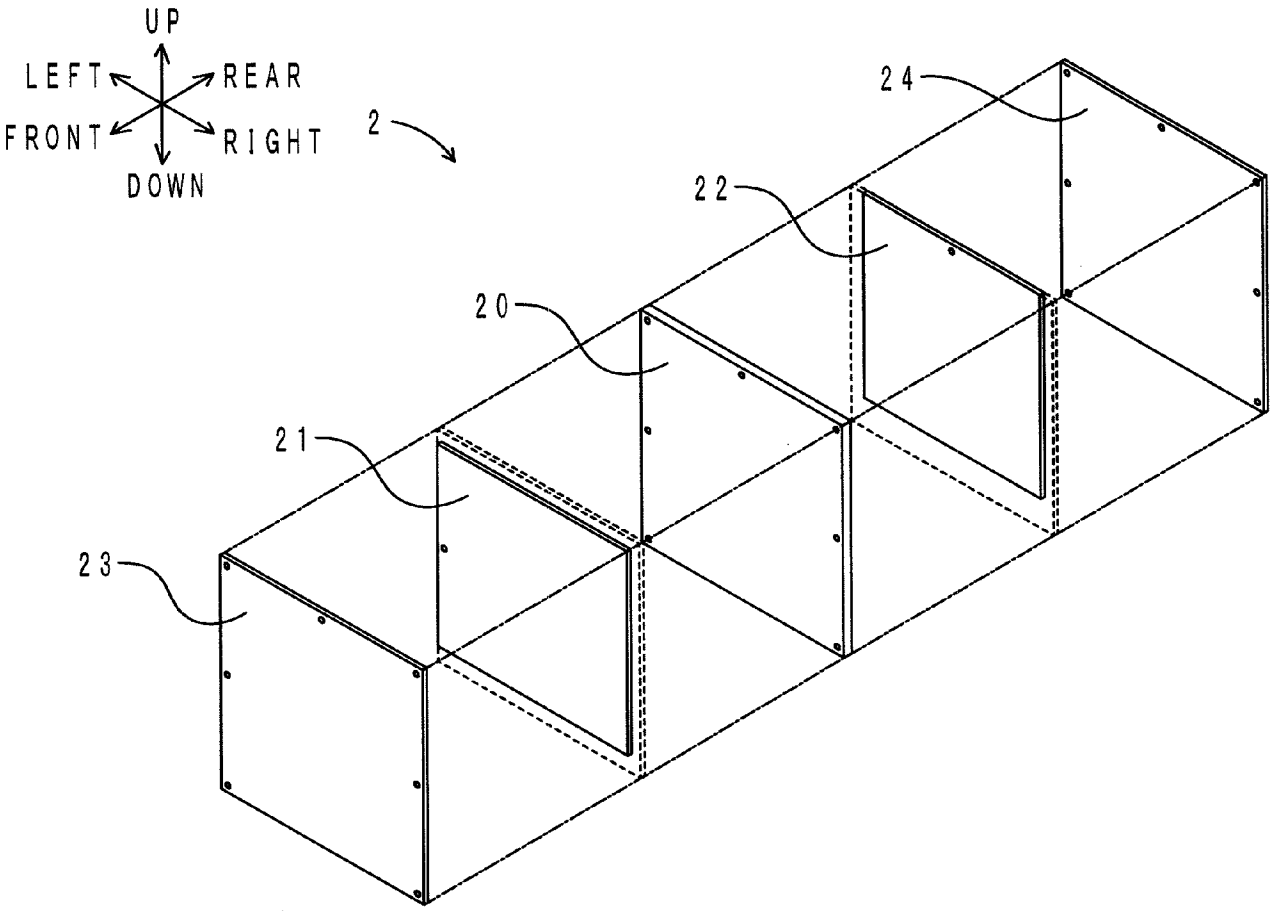
FIG. 5 is an exploded perspective view of a front film assembly of the speaker.

The configuration of the front film assembly 2 of the speaker 1 of the present embodiment will be described below. FIG. 5 is an exploded perspective view of the front film assembly of the speaker of the present embodiment. As shown in FIG. 5, the film assembly 2 includes a dielectric layer 20, a front-side electrode layer 21, a back-side electrode layer 22, a front-side shield layer 23, and a back-side shield layer 24.

Each of these layers is in the form of a quadrilateral film. These layers are stacked in order of the front-side shield layer 23, the front-side electrode layer 21, the dielectric layer 20, the back-side electrode layer 22, and the back-side shield layer 24 from front to rear. Each of the front-side shield layer 23 and the back-side shield layer 24 is made of hydrogenated nitrile rubber (H-NBR). Each of the front-side electrode layer 21 and the back-side electrode layer 22 is made of an electrode material as acrylic rubber containing carbon powder as a filler. The dielectric layer 20 is made of H-NBR. Specifically, the front-side electrode layer 21 and the back-side electrode layer 22 are formed by coating the dielectric layer 20 with a paint containing the electrode material (by, e.g., screen printing etc.).

FIG. 5 shows the sizes of the front-side shield layer 23, the dielectric layer 20, and the back-side shield layer 24 by dotted lines. As shown in FIG. 5, the front-side electrode layer 21 and the back-side electrode layer 22 are smaller than the front-side shield layer 23, the dielectric layer 20, and the back-side shield layer 24.

The upper, lower, and right sides of the front-side electrode layer 21 are neither held nor fixed in the longitudinal direction by the front-side frame member 6 and the back-side frame member 7 shown in FIG. 4. The left side of the front-side electrode layer 21 is held and fixed in the longitudinal direction by the front-side frame member 6 and the back-side frame member 7 shown in FIG. 4. As shown in FIG. 3, the first outer electrode layer terminal 80 extends through the left side of the front-side electrode layer 21. The front-side electrode layer 21 is electrically connected to the first outer electrode layer terminal 80.

As shown in FIG. 5, the left, lower, and right sides of the back-side electrode layer 22 are neither held nor fixed in the longitudinal direction by the front-side frame member 6 and the back-side frame member 7 shown in FIG. 4. The upper side of the back-side electrode layer 22 is held and fixed in the longitudinal direction by the front-side frame member 6 and the back-side frame member 7 shown in FIG. 4. As shown in FIG. 2, the inner electrode layer terminal 84 extends through the upper side of the back-side electrode layer 22. The back-side electrode layer 22 is electrically connected to the inner electrode layer terminal 84.

Configuration of Rear Film Assembly 3

Figure 6:
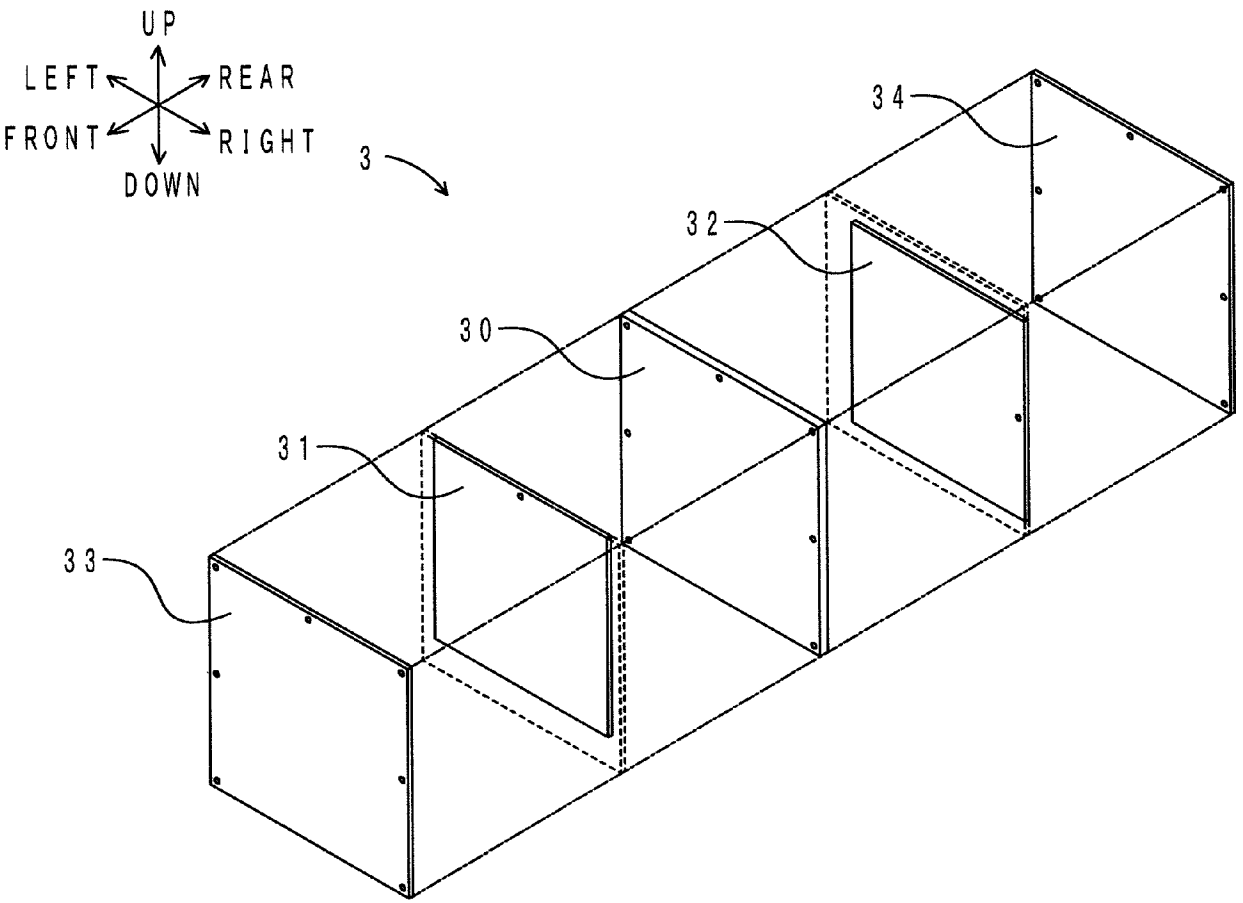
FIG. 6 is an exploded perspective view of a rear film assembly of the speaker.

The configuration of the rear film assembly 3 of the speaker 1 of the present embodiment will be described below. FIG. 6 is an exploded perspective view of the rear film assembly of the speaker of the present embodiment. As shown in FIG. 6, the film assembly 3 includes a dielectric layer 30, a front-side electrode layer 31, a back-side electrode layer 32, a front-side shield layer 33, and a back-side shield layer 34.

Each of these layers is in the form of a quadrilateral film. These layers are stacked in order of the front-side shield layer 33, the front-side electrode layer 31, the dielectric layer 30, the back-side electrode layer 32, and the back-side shield layer 34 from front to rear. Each of the front-side shield layer 33 and the back-side shield layer 34 is made of H-NBR. Each of the front-side electrode layer 31 and the back-side electrode layer 32 is made of an electrode material as acrylic rubber containing carbon powder as a filler. The dielectric layer 30 is made of H-NBR. Specifically, the front-side electrode layer 31 and the back-side electrode layer 32 are formed by coating the dielectric layer 30 with a paint containing the electrode material (by, e.g., screen printing etc.).

FIG. 6 shows the sizes of the front-side shield layer 33, the dielectric layer 30, and the back-side shield layer 34 by dotted lines. As shown in FIG. 6, the front-side electrode layer 31 and the back-side electrode layer 32 are smaller than the front-side shield layer 33, the dielectric layer 30, and the back-side shield layer 34.

The left, lower, and right sides of the front-side electrode layer 31 are neither held nor fixed in the longitudinal direction by the front-side frame member 6 and the back-side frame member 7 shown in FIG. 4. The upper side of the front-side electrode layer 31 is held and fixed in the longitudinal direction by the front-side frame member 6 and the back-side frame member 7 shown in FIG. 4. As shown in FIG. 2, the inner electrode layer terminal 84 extends through the upper side of the front-side electrode layer 31. The front-side electrode layer 31 is electrically connected to the inner electrode layer terminal 84.

As shown in FIG. 6, the upper, lower, and left sides of the back-side electrode layer 32 are neither held nor fixed in the longitudinal direction by the front-side frame member 6 and the back-side frame member 7 shown in FIG. 4. The right side of the back-side electrode layer 32 is held and fixed in the longitudinal direction by the front-side frame member 6 and the back-side frame member 7 shown in FIG. 4. As shown in FIG. 3, the second outer electrode layer terminal 82 extends through the right side of the back-side electrode layer 32. The back-side electrode layer 32 is electrically connected to the second outer electrode layer terminal 82.

Configuration of Circuit Section

Figure 7:
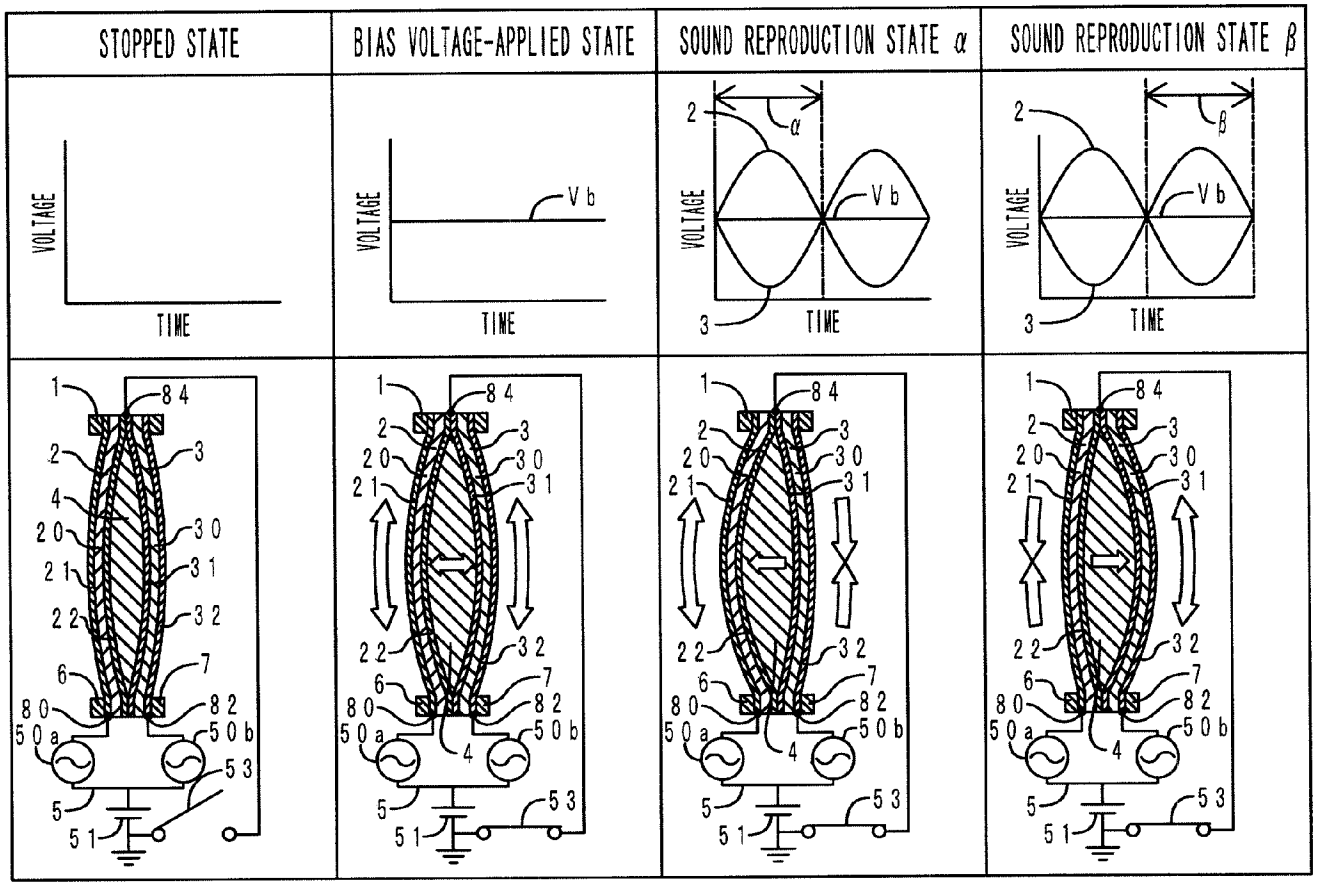
FIG. 7 is an illustration of operation of the speaker.

The configuration of the circuit section of the speaker 1 of the present embodiment will be described below. FIG. 7 is an illustration of operation of the speaker of the present embodiment. FIG. 7 schematically shows the stack. As shown in FIG. 7, the circuit section 5 includes two AC power supplies 50*a*, 50*b*, a DC bias power supply 51, and a switch 53.

The two AC power supplies 50*a*, 50*b* apply AC voltages based on sound to be reproduced, namely signal waves, to the pair of film assemblies 2, 3. Specifically, the AC power supply 50*a* is electrically connected to the first outer electrode layer terminal 80 (i.e., the front-side electrode layer 21 of the film assembly 2). The AC power supply 50*b* is electrically connected to the second outer electrode layer terminal 82 (i.e., the back-side electrode layer 32 of the film assembly 3). The phase of the signal wave of the AC power supply 50*a* is opposite to that of the signal wave of the AC power supply 50*b*. The inner electrode layer terminal 84 (i.e., the back-side electrode layer 22 of the film assembly 2 and the front-side electrode layer 31 of the film assembly 3) is grounded via the switch 53.

The DC bias power supply 51 is placed between the switch 53 and the two AC power supplies 50*a*, 50*b*. The DC bias power supply 51 applies a bias voltage in such a direction in which the voltage increases in the direction from the AC power supply 50*a* toward the first outer electrode layer terminal 80 (i.e., the direction from the AC power supply 50*b* toward the second outer electrode layer terminal 82). That is, the DC bias power supply 51 applies a positive bias voltage.

The DC bias power supply 51 and the AC power supply 50*a* thus superimpose the positive bias voltage on the signal wave and apply the resultant voltage to the film assembly 2. Moreover, the DC bias power supply 51 and the AC power supply 50*b* superimpose the positive bias voltage on the signal wave and apply the resultant voltage to the film assembly 3.

Operation of Speaker 1

Operation of the speaker 1 of the present embodiment will be described below. As shown in FIG. 7, the switch 53 is open in a stopped state. Accordingly, no voltage is applied to the pair of film assemblies 2, 3.

The switch 53 is closed in a bias voltage applied state. Accordingly, a bias voltage Vb is applied to each of the pair of film assemblies 2, 3. When the bias voltage Vb is applied, electrostatic attraction is generated between the front-side electrode layer 21 and the back-side electrode layer 22 of the film assembly 2. Therefore, the dielectric layer 20 contracts in the longitudinal direction. The dielectric layer 20 also expands in the surface direction (the direction perpendicular to the longitudinal direction). Similarly, the dielectric layer 30 of the film assembly 3 contracts in the longitudinal direction. The dielectric layer 30 also expands in the surface direction (the direction perpendicular to the longitudinal direction).

In a sound reproduction state α, signal waves with opposite phases to each other are transmitted to the film assembly 2 and the film assembly 3. The electrostatic attraction between the front-side electrode layer 31 and the back-side electrode layer 32 of the film assembly 3 is reduced. Accordingly, the dielectric layer 30 expands in the longitudinal direction. The dielectric layer 30 also contracts in the surface direction. That is, the tension of the dielectric layer 30 and thus the film assembly 3 is increased. The amount by which the film assembly 3 protrudes rearward is therefore reduced. A load is thus applied to the interposed member 4 in the direction from rear to front. On the contrary, the electrostatic attraction between the front-side electrode layer 21 and the back-side electrode layer 22 of the film assembly 2 is increased. Accordingly, the dielectric layer 20 contracts in the longitudinal direction. The dielectric layer 20 also expands in the surface direction. That is, the tension of the dielectric layer 20 and thus the film assembly 2 is reduced. In other words, the film assembly 2 becomes slack. At this time, a load is being applied from the film assembly 3 to the interposed member 4 in the direction from rear to front. This load eliminates the slackening of the film assembly 2 and causes the film assembly 2 to protrude further forward. In other words, the amount by which the film assembly 2 protrudes forward is increased. In the sound reproduction state α, the pair of film assemblies 2, 3 thus vibrate greatly from rear to front.

In a sound reproduction state 13, signal waves of opposite phases to each other are transmitted to the film assembly 2 and the film assembly 3. However, the waveforms of the signal waves are reversed with respect to the sound reproduction state α. Movement of the film assembly 2 in the sound reproduction state β is similar to that of the film assembly 3 in the sound reproduction state α. Moreover, movement of the film assembly 3 in the sound reproduction state β is similar to that of the film assembly 2 in the sound reproduction state α. In the sound reproduction state β, the pair of film assemblies 2, 3 vibrate greatly from front to rear.

Functions and Effects

Functions and effects of the speaker 1 of the present embodiment will be described below. As shown in FIG. 7, the speaker 1 of the present embodiment includes the pair of film assemblies 2, 3, the interposed member 4, and the circuit section 5. The interposed member 4 is interposed between the pair of film assemblies 2, 3. The circuit section 5 transmits signal waves based on sound to the pair of film assemblies 2, 3 so that the signal waves transmitted to the film assemblies 2, 3 have opposite phases to each other. The pair of film assemblies 2, 3 therefore operate in opposite directions to each other. For example, in the case where the rear film assembly 3 contracts in the surface direction, the front film assembly 2 expands in the surface direction. On the contrary, in the case where the front film assembly 2 contracts in the surface direction, the rear film assembly 3 expands in the surface direction.

According to the speaker 1 of the present embodiment, a load can be transmitted between the pair of film assemblies 2, 3 via the interposed member 4. This can increase longitudinal vibration of the pair of film assemblies 2, 3, and therefore can increase vibration amplitude of the pair of film assemblies 2, 3. Accordingly, low-frequency characteristics of the speaker 1 can be improved despite of a low applied voltage to the film assemblies 2, 3. For example, a sound pressure in a low-frequency region can be increased. Moreover, a frequency region that can be reproduced can be extended to lower frequencies. The speaker of the present embodiment can be reduced in size despite of its high low-frequency characteristics. The speaker 1 of the present embodiment is short in the longitudinal direction. The speaker 1 of the present embodiment is also flexible. The speaker 1 of the present embodiment therefore has great flexibility in installation. Accordingly, for example, the speaker 1 of the present embodiment can be easily placed on a vehicle seat (seating surface, backrest, headrest, etc.), a panel exposed to a vehicle compartment (instrument panel, door trim, ceiling, etc.), etc. In particular, a cushion made of polyurethane foam is used as a buffer in the seat. Accordingly, the same material (polyurethane foam) can be used for the interposed member 4 and the seat.

According to the speaker 1 of the present embodiment, the front-side electrode layers 21, 31 and the back-side electrode layers 22, 32 are formed by coating the dielectric layers 20, 30 with a paint containing the electrode material. Accordingly, formation of the front-side electrode layers 21, 31 and the back-side electrode layers 22, 32 and arrangement of the front-side electrode layers 21, 31 and the back-side electrode layers 22, 32 can be performed simultaneously.

As shown in FIGS. 2 and 3, the interposed member 4 is placed between the pair of film assemblies 2, 3 such that it is compressed in the longitudinal direction. Accordingly, the interposed member 4 has a larger spring constant in the longitudinal direction than in the surface direction. The interposed member 4 is therefore less likely to expand and contract in the longitudinal direction. This can reduce transmission loss of the load between the pair of film assemblies 2, 3. According to the speaker 1 of the present embodiment, the interposed member 4 tends to be deformed in the surface direction. Therefore, the interposed member 4 tends to expand and contract according to expansion and contraction in the surface direction of the film assemblies 2, 3.

According to the speaker 1 of the present embodiment, as shown in FIGS. 5 and 6, each of the film assemblies 2, 3 includes the front-side shield layer 23, 33 and the back-side shield layer 24, 34. Each of the front-side shield layer 23, 33 and the back-side shield layer 24, 34 has insulating properties. According to the speaker 1 of the present embodiment, insulating properties of the film assemblies 2, 3 can therefore be easily ensured.

According to the speaker 1 of the present embodiment, as shown in FIGS. 5 and 6, each of the film assemblies 2, 3 has a structure in which the front-side shield layer 23, 33, the front-side electrode layer 21, 31, the dielectric layer 20, 30, and the back-side electrode layer 22, 32, and the back-side shield layer 24, 34 are stacked from front to rear and held together as an integrated part. This facilitates assembly work of the speaker 1.

According to the speaker 1 of the present embodiment, as shown in FIG. 4, the film assembly 2 and the film assembly 3 are held and fixed in the longitudinal direction by the front-side frame member 6 and the back-side frame member 7. The interposed member 4 is placed inside the frame of the front-side frame member 6 and the back-side frame member 7. That is, the interposed member 4 is indirectly held by the front-side frame member 6 and the back-side frame member 7 with the pair of film assemblies 2, 3 interposed therebetween, respectively. Operation of the interposed member 4 is therefore less likely to be restricted by the front-side frame member 6 and the back-side frame member 7. Accordingly, vibration amplitude of the pair of film assemblies 2, 3 can be increased.

According to the speaker 1 of the present embodiment, as shown in FIGS. 2 and 3, each of the pair of film assemblies 2, 3 has a fixed portion P1 (portion fixed by the front-side frame member 6 and the back-side frame member 7) and an in-frame portion P2 (portion located inside the frame of the front-side frame member 6 and the back-side frame member 7). A hinge fulcrum (fulcrum of vibration of the in-frame portion P2) can be placed at the boundary between the fixed portion P1 and the in-frame portion P2.

According to the speaker 1 of the present embodiment, as shown in FIG. 4, each of the front-side frame member 6 and the back-side frame member 7 has pairs of opposite sides 60L, 60R, 61U, 61D, 70L, 70R, 71U, 71D facing each other in the surface direction. The film assemblies 2, 3 can therefore be greatly vibrated with respect to the hinge fulcrum. Vibration amplitude of the pair of film assemblies 2, 3 can thus be increased.

According to the speaker 1 of the present embodiment, as shown in FIG. 7, the circuit section 5 superimposes the signal wave on the positive bias voltage and applies the resultant voltage to the front-side electrode layer 21 of the front film assembly 2. The circuit section 5 superimposes the signal wave on the positive bias voltage and applies the resultant voltage to the back-side electrode layer 32 of the rear film assembly 3. The back-side electrode layer 22 of the front film assembly 2 and the front-side electrode layer 31 of the rear film assembly 3 are grounded. Accordingly, the pair of film assemblies 2, 3 can be easily operated in opposite directions.

Speaker installation spaces typically have a quadrilateral shape. If a speaker has a perfect circular shape and such a speaker is placed in a quadrilateral speaker installation space, dead space tends to be created in the four corners. The speaker 1 of the present embodiment has a quadrilateral shape. Accordingly, even if the speaker 1 is placed in a quadrilateral speaker installation space, dead space is less likely to be created in the speaker installation space.

According to the speaker 1 of the present embodiment, as shown in FIGS. 2 and 3, the film assembly 2 protrudes forward, and the film assembly 3 protrudes rearward. That is, the pair of film assemblies 2, 3 form the shape of a double-convex lens. Therefore, the film assemblies 2, 3 are less extended from radially outward toward radially inward in the stopped state shown in FIG. 7, as compared to the case where the film assembly 2 is recessed rearward and the film assembly 3 is recessed forward (that is, the pair of film assemblies 2, 3 form the shape of a double-concave lens). Moreover, in the sound reproduction state as well, the film assemblies 2, 3 are less likely to be excessively extended from radially outward toward radially inward. This can improve durability of the film assemblies 2, 3 and thus the speaker 1. No vibration plate is required in the speaker 1 of the present embodiment. This can reduce the weight of the speaker, and therefore can achieve efficient conversion of an audio signal.

Second Embodiment

Figure 8:
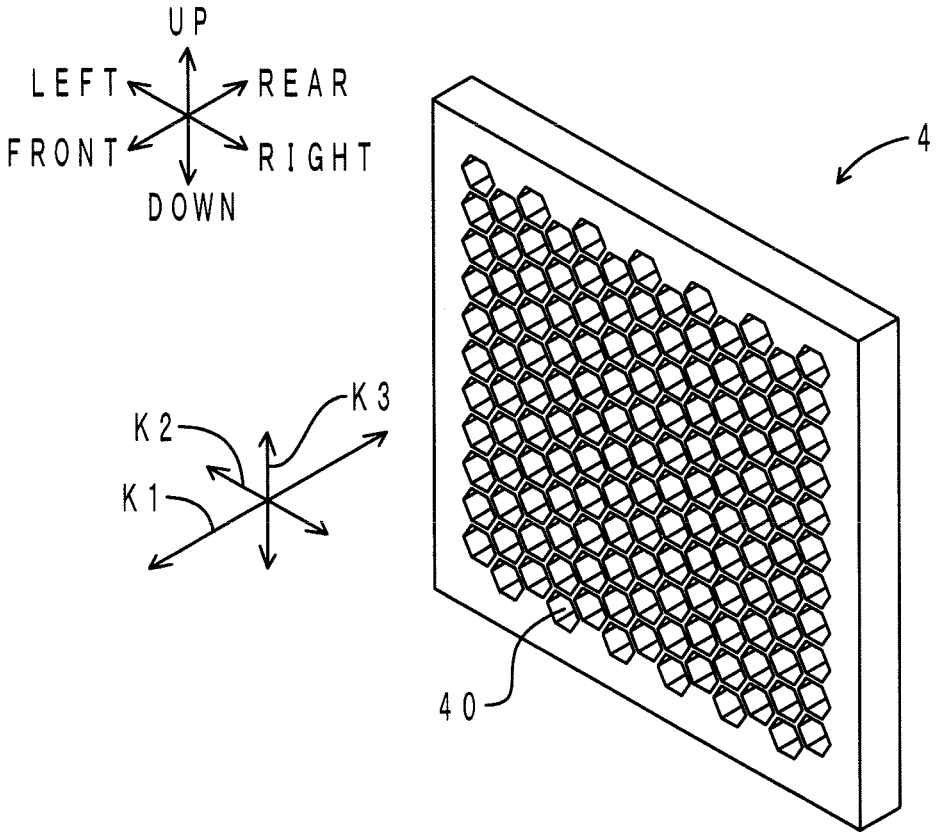
FIG. 8 is a perspective view of an interposed member of a speaker of a second embodiment.

A speaker of the present embodiment is different from that of the first embodiment in that the interposed member has a honeycomb structure. Only the differences from the first embodiment will be described below. FIG. 8 is a perspective view of the interposed member of the speaker of the present embodiment. In FIG. 8, the portions corresponding to those of FIG. 4 are denoted with the same reference characters.

As shown in FIG. 8, the interposed member 4 is made of paper and in the form of a quadrilateral plate. The interposed member 4 has a multiplicity of hexagonal holes 40. The multiplicity of holes 40 extend through the interposed member 4 in the longitudinal direction. The multiplicity of holes 40 are regularly arranged in the lateral and vertical directions.

A hole wall between each pair of adjoining holes 40 tends to be elastically deformed in the lateral and vertical directions. The interposed member 4 therefore tends to expand and contract in the lateral and vertical directions. That is, the interposed member 4 has small spring constants in the surface direction (a spring constant K2 in the lateral direction and a spring constant K3 in the vertical direction).

On the other hand, the hole wall between each pair of adjoining holes 40 is less likely to be elastically deformed in the longitudinal direction. The interposed member 4 is therefore less likely to expand and contract in the longitudinal direction. That is, the interposed member 4 has a large spring constant K1 in the longitudinal direction.

The speaker of the present embodiment and the speaker of the first embodiment have similar functions and effects for the portions having the same configuration. According to the speaker of the present embodiment, the spring constant K1 in the longitudinal direction of the interposed member 4 is larger than the spring constants in the surface direction thereof (the spring constant K2 in the lateral direction and the spring constant K3 in the vertical direction). This can reduce transmission loss of the load between the pair of film assemblies. According to the speaker of the present embodiment, the interposed member 4 tends to be deformed in the surface direction. Therefore, the interposed member 4 tends to expand and contract according to expansion and contraction in the surface direction of the film assemblies.

Third Embodiment

Figure 9:
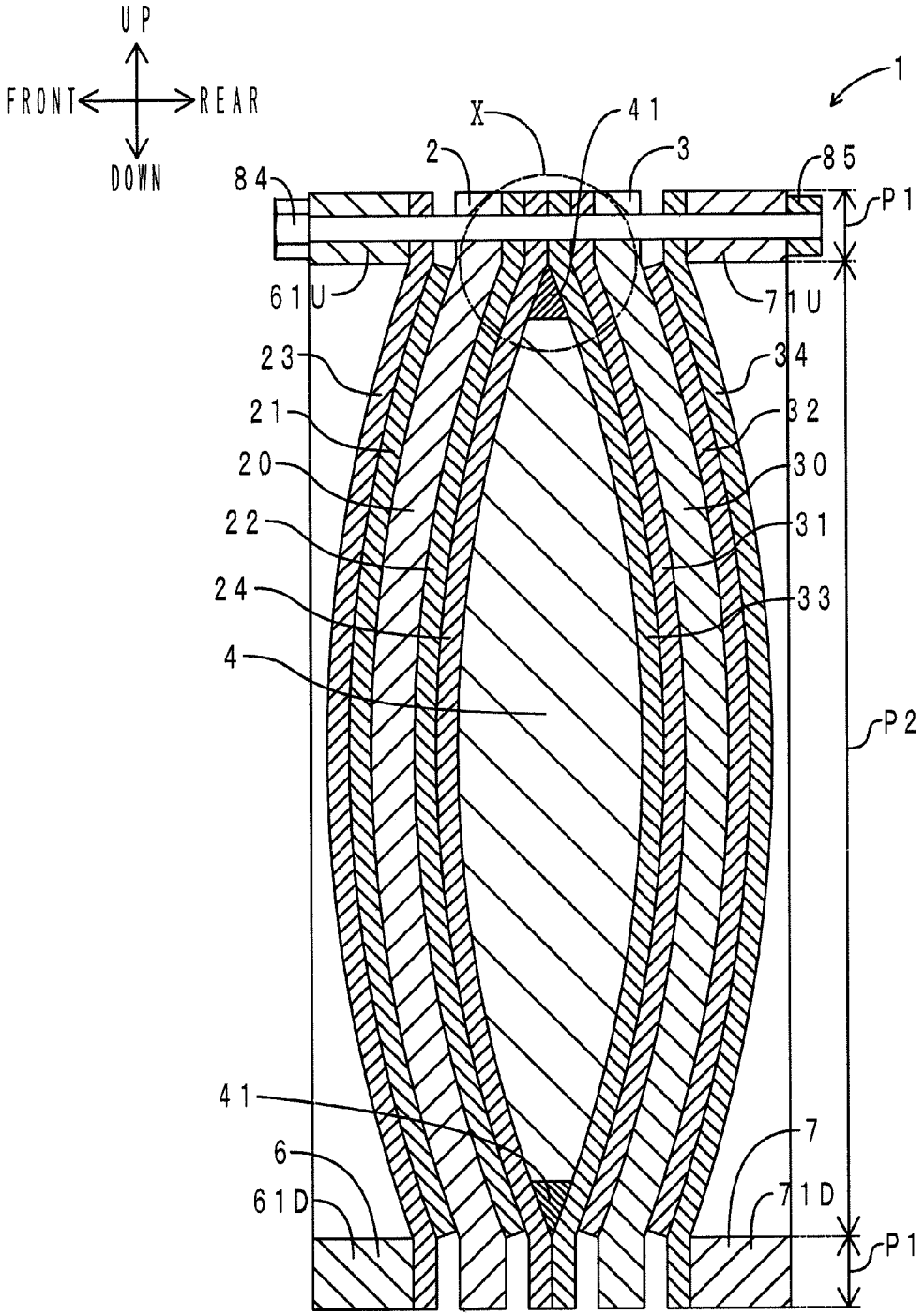
FIG. 9 is a longitudinal sectional view of a speaker of a third embodiment.

A speaker of the present embodiment is different from that of the first embodiment in that four edge members are placed outside the interposed member in the surface direction. Only the differences from the first embodiment will be described below. FIG. 9 is a longitudinal sectional view of the speaker of the present embodiment. In FIG. 9, the portions corresponding to those of FIG. 2 are denoted with the same reference characters.

As shown in FIG. 9, edge members 41 are placed outside the interposed member 4 in the surface direction so as to extend along each side (upper, lower, left, and right sides). Each of the edge members 41 is made of a resin and in the form of a triangular prism with a vertex facing outward. The edge members 41 are more rigid than the interposed member 4 and the film assemblies 2, 3.

Figure 10:
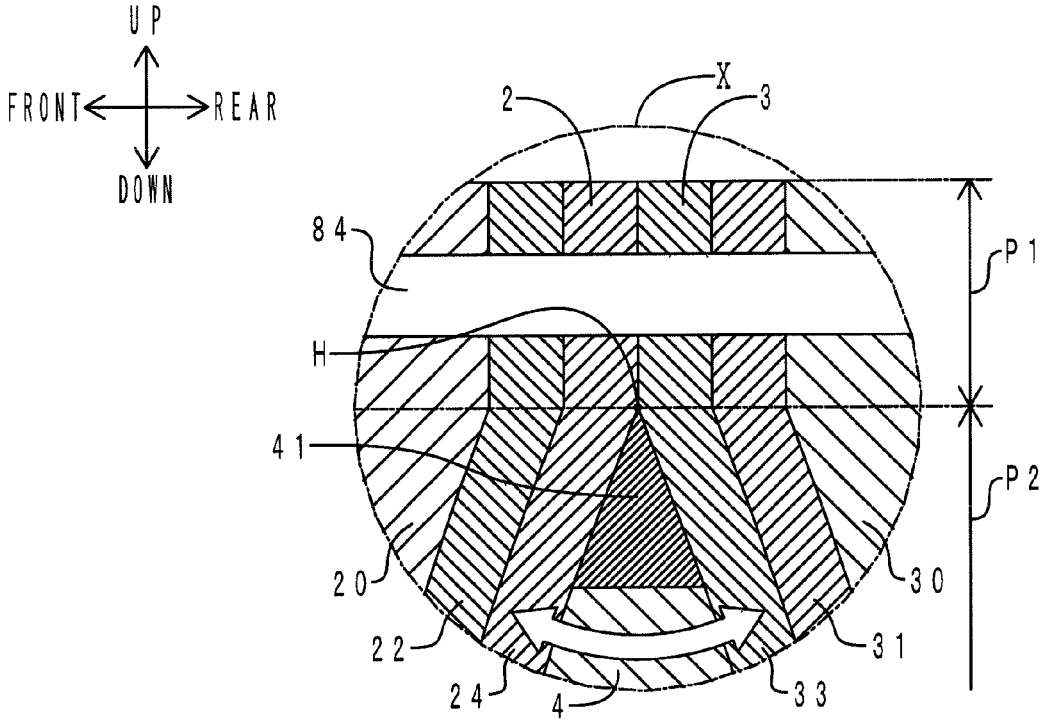
FIG. 10 is an enlarged view of a region in a circle X of FIG. 9.

FIG. 10 is an enlarged view of a region in a circle X in FIG. 9. As shown in FIG. 10, a hinge fulcrum H is set at the boundary between the fixed portion P1 and the in-frame portion P2. The hinge fulcrum H serves as a fulcrum of vibration of the in-frame portion P2. The vertex of the edge member 41 is placed at the hinge fulcrum H.

The speaker 1 of the present embodiment and the speaker of the first embodiment have similar functions and effects for the portions having the same configuration. According to the speaker 1 of the present embodiment, the vertex of the edge member 41 is placed at the hinge fulcrum H. The hinge fulcrum H is therefore less likely to be shifted. That is, the fulcrum is less likely to be shifted as the in-frame portion P2 vibrates. The film assemblies 2, 3 can therefore be greatly vibrated. Vibration amplitude of the pair of film assemblies 2, 3 can thus be increased.

Fourth Embodiment

Figure 11:
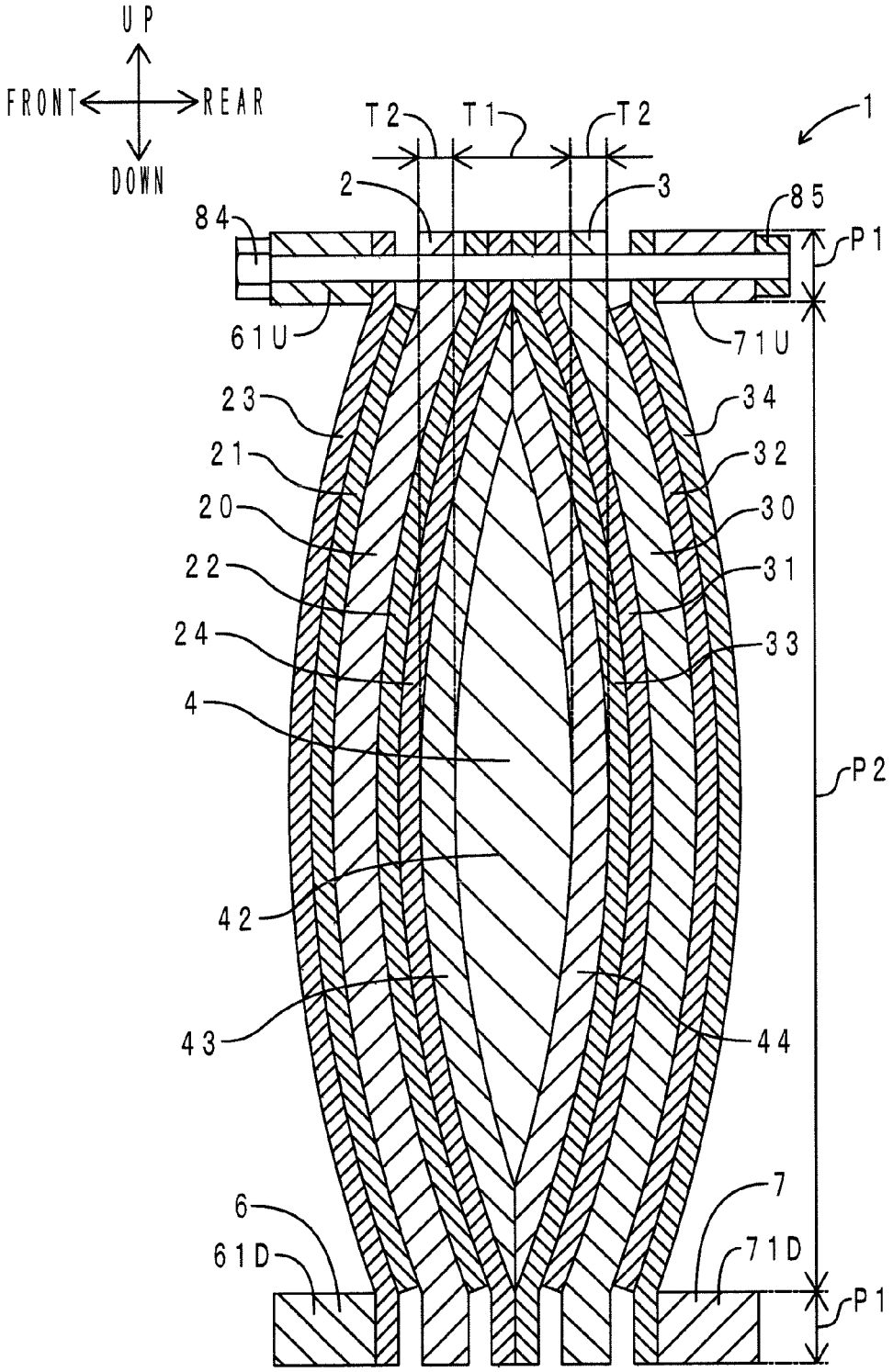
FIG. 11 is a vertical sectional view of a speaker of a fourth embodiment.

A speaker of the present embodiment is different from that of the first embodiment in that the interposed member has a three-layer structure. Only the differences from the first embodiment will be described below. FIG. 11 is a vertical sectional view of the speaker of the present embodiment. In FIG. 11, the portions corresponding to those of FIG. 2 are denoted with the same reference characters.

As shown in FIG. 11, the interposed member 4 includes an inner interposed body 42 and a pair of outer interposed bodies 43, 44. The inner interposed body 42 is made of polystyrene foam and in the form of a quadrilateral plate. Each of the outer interposed bodies 43, 44 is made of polyurethane foam and in the form of a quadrilateral plate. The outer interposed body 43 is stacked in front of the inner interposed body 42. The outer interposed body 44 is stacked behind the inner interposed body 42.

The inner interposed body 42 has a larger spring constant in the longitudinal direction than the outer interposed bodies 43, 44. The inner interposed body 42 has larger spring constants in the vertical and lateral directions than the outer interposed bodies 43, 44. The density of the inner interposed body 42 is equal to or lower than that of the outer interposed bodies 43, 44. Regarding the longitudinal thickness of the central portion in the vertical and lateral directions, the thickness T1 of the inner interposed body 42 is larger than the thickness T2 of the outer interposed bodies 43, 44.

The speaker 1 of the present embodiment and the speaker of the first embodiment have similar functions and effects for the portions having the same configuration. According to the speaker 1 of the present embodiment, the entire interposed member 4 can be pressed against the film assemblies 2, 3 by the elastic force of the soft outer interposed bodies 43, 44. The entire film assemblies 2, 3 each can therefore be vibrated uniformly. Accordingly, the phase of the vibration wave is less likely to vary across each of the film assemblies 2, 3. According to the speaker 1 of the present embodiment, transmission loss of the load between the pair of film assemblies 2, 3 can be reduced by the elastic force of the hard inner interposed body 42.

According to the speaker 1 of the present embodiment, the inner interposed body 42 is made of polystyrene foam, and the outer interposed bodies 43, 44 are made of polyurethane foam. This can reduce the weight of the interposed member 4, and therefore can reduce the transmission loss of the load between the pair of film assemblies 2, 3. The outer interposed bodies 43, 44 made of polyurethane foam are porous. The outer interposed bodies 43, 44 therefore have a small contact area with the film assemblies 2, 3, respectively. This reduces friction resistance between the film assembly 2, 3 and the outer interposed body 43, 44. Accordingly, expansion and contraction in the vertical and lateral directions of the film assemblies 2, 3 are less likely to be inhibited by the outer interposed bodies 43, 44.

According to the speaker 1 of the present embodiment, the thickness T1 of the hard inner interposed body 42 is larger than the thickness T2 of the soft outer interposed bodies 43, 44. This can reduce the transmission loss of the load between the pair of film assemblies 2, 3.

Fifth Embodiment

Figure 12:
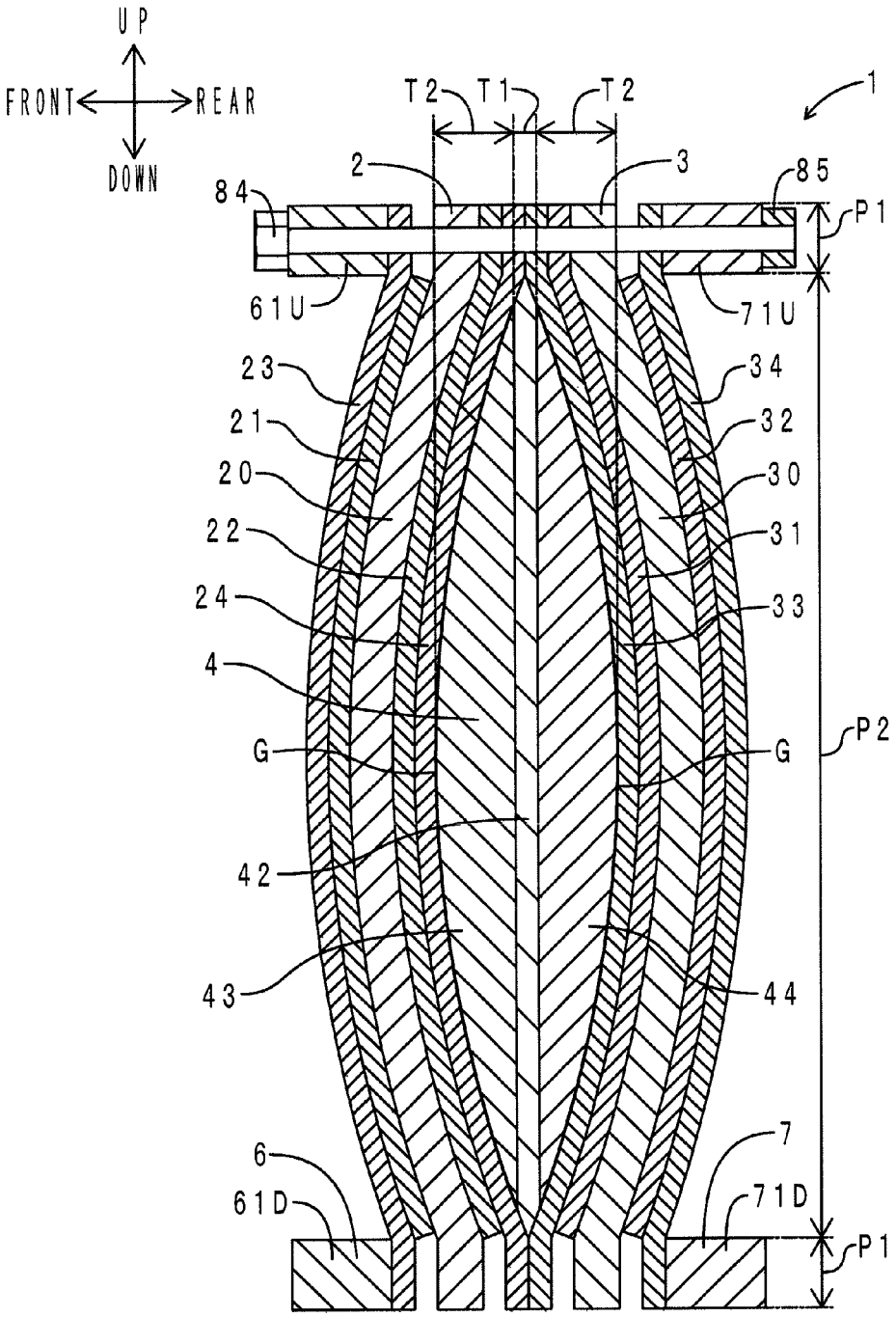
FIG. 12 is a vertical sectional view of a speaker of a fifth embodiment.

A speaker of the present embodiment is different from that of the first embodiment in that the interposed member has a three-layer structure. Only the differences from the first embodiment will be described below. FIG. 12 is a vertical sectional view of the speaker of the present embodiment. In FIG. 12, the portions corresponding to those of FIG. 2 are denoted with the same reference characters.

As shown in FIG. 12, the interposed member 4 includes an inner interposed body 42 and a pair of outer interposed bodies 43, 44. The inner interposed body 42 is made of polyurethane foam and in the form of a quadrilateral plate. Each of the outer interposed bodies 43, 44 is made of polystyrene foam and in the form of a quadrilateral plate. The outer interposed body 43 is stacked in front of the inner interposed body 42. As shown by thick line, grease G is applied to the front surface (outer surface) of the outer interposed body 43. The outer interposed body 44 is stacked behind the inner interposed body 42. As shown by thick line, grease G is applied to the rear surface (outer surface) of the outer interposed body 44.

The inner interposed body 42 has a smaller spring constant in the longitudinal direction than the outer interposed bodies 43, 44. The inner interposed body 42 has smaller spring constants in the vertical and lateral directions than the outer interposed bodies 43, 44. The density of the outer interposed bodies 43, 44 is equal to or lower than that of the inner interposed body 42. Regarding the longitudinal thickness of the central portion in the vertical and lateral directions, the thickness T2 of the outer interposed bodies 43, 44 is larger than the thickness T1 of the inner interposed body 42.

The speaker 1 of the present embodiment and the speaker of the first embodiment have similar functions and effects for the portions having the same configuration. According to the speaker 1 of the present embodiment, the entire interposed member 4 can be pressed against the film assemblies 2, 3 by the elastic force of the soft inner interposed body 42. The entire film assemblies 2, 3 each can therefore be vibrated uniformly. Accordingly, the phase of the vibration wave is less likely to vary across each of the film assemblies 2, 3. According to the speaker 1 of the present embodiment, transmission loss of the load between the pair of film assemblies 2, 3 can be reduced by the elastic force of the hard outer interposed bodies 43, 44.

According to the speaker 1 of the present embodiment, the outer interposed bodies 43, 44 are made of polystyrene foam, and the inner interposed body 42 is made of polyurethane foam. This can reduce the weight of the interposed member 4, and therefore can reduce the transmission loss of the load between the pair of film assemblies 2, 3.

According to the speaker 1 of the present embodiment, the thickness T2 of the hard outer interposed bodies 43, 44 is larger than the thickness T1 of the soft inner interposed body 42. This can reduce the transmission loss of the load between the pair of film assemblies 2, 3.

According to the speaker 1 of the present embodiment, the grease G is applied to the front surface of the outer interposed body 43 and the rear surface of the outer interposed body 44. This reduces friction resistance between the outer interposed body 43 and the back-side shield layer 24, and also reduces friction resistance between the outer interposed body 44 and the front-side shield layer 33. Accordingly, expansion and contraction in the vertical and lateral directions of the film assemblies 2, 3 are less likely to be inhibited by the outer interposed bodies 43, 44.

Others

The embodiments of the speaker according to the present invention are described above. However, embodiments are not particularly limited to those described above. Various modifications and improvements may be made by those skilled in the art.

In the above embodiments, the speaker 1 is placed so that the front-back direction of the speaker 1 corresponds to the longitudinal direction. However, the direction in which the speaker 1 is placed is not particularly limited. For example, the speaker 1 may be placed so that the front-back direction of the speaker 1 corresponds to the lateral direction or the vertical direction.

The structure, material, etc. of the interposed member 4 are not particularly limited. For example, the interposed member 4 may be a solid body, a porous body (e.g., a sponge material), a foam body (e.g., a foam material), a hollow body, etc. In the case of the hollow body, the interposed member 4 may be filled with gas, liquid, etc. The sectional shape of the holes 40 along the direction perpendicular to the axis is not particularly limited, and may be at least one selected from a perfect circle, an ellipse, an elongated hole, a polygon (triangle, quadrangle, pentagon, heptagon, etc.). The shape of the speaker 1 as viewed from the front or rear is not particularly limited, and may be a perfect circle, an ellipse, an elongated hole, a polygon (triangle, pentagon, hexagon, heptagon, etc.), etc. Both front and rear surfaces of the interposed member 4 may have a concave shape. This makes it easier to cause the film assembly 2 to protrude forward and to cause the film assembly 3 to protrude rearward.

In the case of using polystyrene foam as a material of the interposed member 4, the manufacturing method of the interposed member 4 is not particularly limited. That is, any of expanded polystyrene (EPS), polystyrene paper (PSP), and extruded polystyrene (XPS) may be used as the interposed member 4.

The number of stacks of the "front-side electrode layer 21, 31, the dielectric layer 20, 30, and the back-side electrode layer 22, 32" in each film assembly 2, 3 is not particularly limited. The vibration amplitude of the pair of film assemblies 2, 3 can be increased as the number of stacks is increased.

The method of placing the front-side electrode layer 21, 31 and the back-side electrode layer 22, 32 on the dielectric layer 20, 30 is not particularly limited. For example, the front-side electrode layer 21, 31 and the back-side electrode layer 22, 32, which are produced separately from the dielectric layer 20, 30 (e.g., produced by cutting an original material sheet), may be bonded to the dielectric layer 20, 30. This allows the front-side electrode layer 21, 31 and the back-side electrode layer 22, 32 to be firmly fixed to the dielectric layer 20, 30. The back surface of the front-side shield layer 23, 33 may be coated with the front-side electrode layer 21, 31, or the front-side electrode layer 21, 31 may be bonded to the back surface of the front-side shield layer 23, 33. Similarly, the front surface of the back-side shield layer 24, 34 may be coated with the back-side electrode layer 22, 32, or the back-side electrode layer 22, 32 may be bonded to the front surface of the back-side shield layer 24, 34.

The configuration of the circuit section 5 is not particularly limited. The dedicated DC bias power supply 51 for the AC power supply 50*a* and the dedicated DC bias power supply 51 for the AC power supply 50*b* may be separately provided. The DC bias power supply 51 may be placed between the AC power supply 50*a* and the first outer electrode layer terminal 80. Moreover, the DC bias power supply 51 may be placed between the AC power supply 50*b* and the second outer electrode layer terminal 82.

The method of applying AC voltages (signal waves) of opposite phases to each other from the two AC power supplies 50*a*, 50*b* to the pair of film assemblies 2, 3 is not particularly limited. The AC power supply 50*b* may be omitted by placing one AC power supply 50*a* and a phase inversion circuit. Alternatively, a signal wave based on the phase of real sound is applied from the AC power supply 50*a* to the film assembly 2, and a signal wave produced by inverting the phase of this signal wave may be applied from the AC power supply 50*b* to the film assembly 3. On the contrary, a signal wave based on the phase of real sound is applied from the AC power supply 50*b* to the film assembly 3, and a signal wave produced by inverting the phase of this signal wave may be applied from the AC power supply 50*a* to the film assembly 2.

The fifth embodiment is described with respect to an example in which the grease G is applied to the front surface of the outer interposed body 43 and the rear surface of the outer interposed body 44. However, the grease G may not be applied thereto.

The material of the dielectric layers 20, 30 is not particularly limited. The dielectric layers 20, 30 need only be made of an elastomer or resin. For example, it is preferable to use an elastomer having a high dielectric constant. Specifically, it is preferable to use an elastomer having a specific dielectric constant (100 Hz) of 2 or more, and more preferably 5 or more, at room temperature. Examples of such an elastomer includes an elastomer having a polar functional group such as an ester group, a carboxyl group, a hydroxyl group, a halogen group, an amide group, a sulfone group, a urethane group, or a nitrile group, and an elastomer containing a polar low molecular weight compound having such a polar functional group. Preferable elastomers other than H-NBR include silicone rubber, acrylonitrile-butadiene rubber (NBR), ethylene propylene diene rubber (EPDM), acrylic rubber, urethane rubber, epichlorohydrin rubber, chlorosulfonated polyethylene, chlorinated polyethylene, etc. Preferable resins include polyethylene, polypropylene, polyurethane, polystyrene (including crosslinked polystyrene foam), polyvinyl chloride, a vinylidene chloride copolymer, an ethylene-vinyl acetate copolymer, etc. The material of the front-side shield layers 23, 33 and the back-side shield layers 24, 34 is not particularly limited. The front-side shield layers 23, 33 and the back-side shield layers 24, 34 may be made of a material similar to that of the dielectric layers 20, 30.

The material of the front-side electrode layers 21, 31 and the back-side electrode layers 22, 32 is not particularly limited. For example, the front-side electrode layers 21, 31 and the back-side electrode layers 22, 32 may be made of a flexible conductive material as silicone rubber, acrylic rubber, or H-NBR containing silver powder or carbon as a filler. The front-side electrode layers 21, 31 and the back-side electrode layers 22, 32 may be made of a metal or a carbon material. For example, the front-side electrode layers 21, 31 and the back-side electrode layers 22, 32 may be formed by weaving a mesh of a metal etc. so that the front-side electrode layers 21, 31 and the back-side electrode layers 22, 32 have stretching properties. The front-side electrode layers 21, 31 and the back-side electrode layers 22, 32 may be made of a conductive polymer such as polyethylenedioxythiophene (PEDOT). In the case of using a flexible conductive material containing a binder and a conductive material, an elastomer is preferably used as the binder. Preferable examples of the elastomer include silicone rubber, NBR, EPDM, natural rubber, styrene-butadiene rubber (SBR), acrylic rubber, urethane rubber, epichlorohydrin rubber, chlorosulfonated polyethylene, and chlorinated polyethylene. The conductive material can be selected as appropriate from carbon materials such as carbon black, carbon nanotubes, and graphite, metal materials such as silver, gold, copper, nickel, rhodium, palladium, chromium, titanium, platinum, iron, and alloys thereof, and conductive oxides such as indium tin oxide (ITO) or titanium oxide or zinc oxide doped with other metal such as aluminum or antimony. One kind of material may be used independently as the conductive material, or two or more kinds of material may be mixed as the conductive material.

Examples

The experimental result of sound volume measurement carried out for the speaker of the first embodiment shown in FIG. 2 (hereinafter Example 1) and the speaker of the fourth embodiment shown in FIG. 11 (hereinafter Example 2) will be described below. The experiments were conducted according to JISC5532 (sound system speakers).

Figure 13:
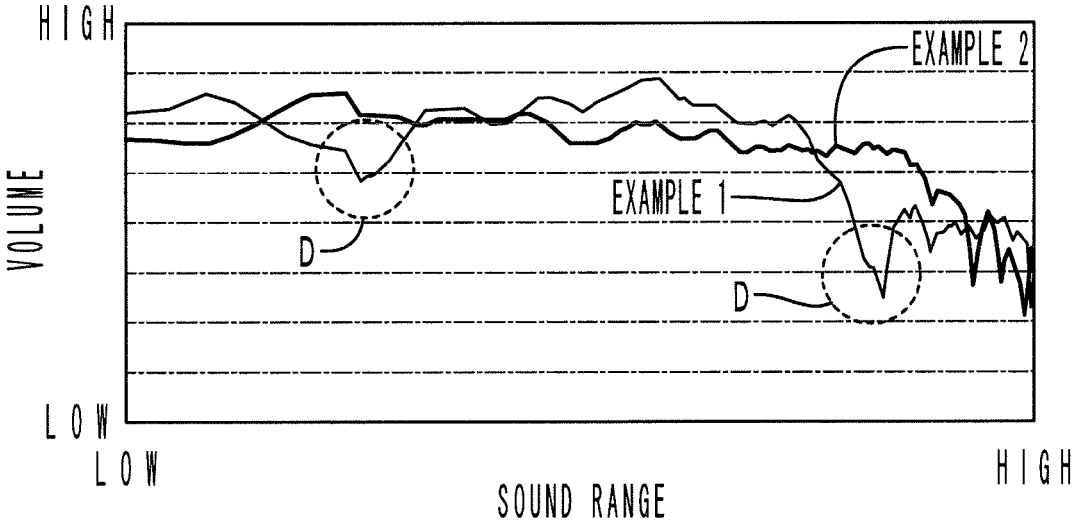
FIG. 13 is a graph showing the experimental result of sound volume measurement.

FIG. 13 is a graph showing the experimental result of the sound volume measurement. The abscissa (logarithmic scale) denotes a sound range, and the ordinate represents the sound volume. As shown in FIG. 13, Example 1 has dips D in certain sound ranges where the sound volume decreases. On the other hand, Example 2 (thick line) has no dip D. This shows that the use of the interposed member 4 having a three-layer structure (the outer interposed body 43, the inner interposed body 42, and the outer interposed body 44) can suppress variation in sound volume in a wide sound range.

The invention claimed is:

1. A speaker, comprising:

a pair of front-side and back-side vibration portions each having a dielectric layer having insulating properties and made of an elastomer or resin, a front-side electrode layer placed on a front side of the dielectric layer and having conductive properties, and a back-side electrode layer placed on a back side of the dielectric layer and having conductive properties;

an interposed member placed between the pair of front-side and back-side vibration portions so that the front-side vibration portion protrudes toward a front side and the back-side vibration portion protrudes toward a back side; and a circuit that transmits signal waves based on sound to be reproduced to the pair of front-side and back-side vibration portions so that the signal waves transmitted to the pair of front-side and back-side vibration portions have opposite phases to each other, and drives the pair of front-side and back-side vibration portions, wherein the interposed member has a larger spring constant in a front-back direction than in a surface direction.

2. The speaker according to claim 1, wherein the circuit superimposes bias voltages of a same polarity on the signal waves with the opposite phases to each other, and applies respective resultant voltages to the front-side electrode layer of the front-side vibration portion and the back-side electrode layer of the back-side vibration portion, and the back-side electrode layer of the front-side vibration portion and the front-side electrode layer of the back-side vibration portion are grounded.

3. The speaker according to claim 1, wherein at least of the pair of front-side and back-side vibration portions has a front-side shield layer placed on a front side of the front-side electrode layer, having insulating properties, and made of an elastomer, and a back-side shield layer placed on a back side of the back-side electrode layer, having insulating properties, and made of an elastomer.

4. The speaker according to claim 3, wherein the at least one of the pair of front-side and back-side vibration portions is a film assembly in which the front-side shield layer, the front-side electrode layer, the dielectric layer, the back-side electrode layer, and the back-side shield layer are stacked from the front side toward the back side.

5. The speaker according to claim 4, further comprising:

a front-side frame member placed on a front side of the front-side film assembly, and a back-side frame member placed on a back side of the back-side film assembly, wherein the front-side film assembly and the back-side film assembly are held and fixed in the front-back direction by the front-side frame member and the back-side frame member.

6. The speaker according to claim 5, wherein each of the front-side frame member and the back-side frame member has a pair of opposite sides facing each other in the surface direction.

7. The speaker according to claim 1, wherein the interposed member has a plurality of interposed bodies stacked in the front-back direction, and at least two of the plurality of interposed bodies have different spring constants from each other in the front-back direction.

8. A speaker, comprising:

a pair of front-side and back-side vibration portions each having a dielectric layer having insulating properties and made of an elastomer or resin, a front-side electrode layer placed on a front side of the dielectric layer and having conductive properties, and a back-side electrode layer placed on a back side of the dielectric layer and having conductive properties;

an interposed member placed between the pair of front-side and back-side vibration portions so that the front-side vibration portion protrudes toward a front side and the back-side vibration portion protrudes toward a back side; and a circuit that transmits signal waves based on sound to be reproduced to the pair of front-side and back-side vibration portions so that the signal waves transmitted to the pair of front-side and back-side vibration portions have opposite phases to each other, and drives the pair of front-side and back-side vibration portions, wherein the interposed member has a plurality of interposed bodies stacked in a front-back direction, and at least two of the plurality of interposed bodies have different spring constants from each other in the front-back direction.

9. The speaker according to claim 8, wherein the plurality of interposed bodies are an inner interposed body, and a pair of outer interposed bodies stacked on both sides of the inner interposed body in the front-back direction and contacting the pair of front-side and back-side vibration portions, and the inner interposed body has a smaller spring constant in the front-back direction than the pair of outer interposed bodies.

10. A speaker, comprising:

a pair of front-side and back-side vibration portions each having a dielectric layer having insulating properties and made of an elastomer or resin, a front-side electrode layer placed on a front side of the dielectric layer and having conductive properties, and a back-side electrode layer placed on a back side of the dielectric layer and having conductive properties;

an interposed member placed between the pair of front-side and back-side vibration portions so that the front-side vibration portion protrudes toward a front side and the back-side vibration portion protrudes toward a back side; and a circuit that transmits signal waves based on sound to be reproduced to the pair of front-side and back-side vibration portions so that the signal waves transmitted to the pair of front-side and back-side vibration portions have opposite phases to each other, and drives the pair of front-side and back-side vibration portions, wherein the circuit superimposes bias voltages of a same polarity on the signal waves with the opposite phases to each other, and applies respective resultant voltages to the front-side electrode layer of the front-side vibration portion and the back-side electrode layer of the back-side vibration portion, and the back-side electrode layer of the front-side vibration portion and the front-side electrode layer of the back-side vibration portion are grounded.

11. The speaker according to claim 10, wherein at least one of the pair of front-side and back-side vibration portions has a front-side shield layer placed on a front side of the front-side electrode layer, having insulating properties, and made of an elastomer, and a back-side shield layer placed on a back side of the back-side electrode layer, having insulating properties, and made of an elastomer.

12. The speaker according to claim 11, wherein the at least one of the pair of front-side and back-side vibration portions is a film assembly in which the front-side shield layer, the front-side electrode layer, the dielectric layer, the back-side electrode layer, and the back-side shield layer are stacked from the front side toward the back side.

13. The speaker according to claim 12, further comprising:

a front-side frame member placed on a front side of the front-side film assembly, and a back-side frame member placed on a back side of the back-side film assembly, wherein the front-side film assembly and the back-side film assembly are held and fixed in a front-back direction by the front-side frame member and the back-side frame member.

14. The speaker according to claim 13, wherein each of the front-side frame member and the back-side frame member has a pair of opposite sides facing each other in a surface direction.

15. The speaker according to claim 10, wherein the interposed member has a plurality of interposed bodies stacked in a front-back direction, and at least two of the plurality of interposed bodies have different spring constants from each other in the front-back direction.

16. The speaker according to claim 8, wherein the plurality of interposed bodies are an inner interposed body, and a pair of outer interposed bodies stacked on both sides of the inner interposed body in the front-back direction and contacting the pair of front-side and back-side vibration portions, and the inner interposed body has a larger spring constant in the front-back direction than the pair of outer interposed bodies.

17. The speaker according to claim 8, wherein at least one of the pair of front-side and back-side vibration portions has a front-side shield layer placed on a front side of the front-side electrode layer, having insulating properties, and made of an elastomer, and a back-side shield layer placed on a back side of the back-side electrode layer, having insulating properties, and made of an elastomer.

18. The speaker according to claim 17, wherein the at least one of the pair of front-side and back-side vibration portions is a film assembly in which the front-side shield layer, the front-side electrode layer, the dielectric layer, the back-side electrode layer, and the back-side shield layer are stacked from the front side toward the back side.

19. The speaker according to claim 18, further comprising:

a front-side frame member placed on a front side of the front-side film assembly, and a back-side frame member placed on a back side of the back-side film assembly, wherein the front-side film assembly and the back-side film assembly are held and fixed in the front-back direction by the front-side frame member and the back-side frame member.

20. The speaker according to claim 19, wherein each of the front-side frame member and the back-side frame member has a pair of opposite sides facing each other in a surface direction.

* * * * *

UNITED STATES PATENT AND TRADEMARK OFFICE

CERTIFICATE OF CORRECTION

PATENT NO. : 9,288,583 B2
APPLICATION NO. : 14/325831
DATED : March 15, 2016
INVENTOR(S) : Nakano et al.

It is certified that error appears in the above-identified patent and that said Letters Patent is hereby corrected as shown below:

Title Page, item (71), Applicant, please change, "(KR)" to --(JP)--
Title Page, item (72), Inventors, please change, "(KR)" to --(JP)--

Signed and Sealed this
Twenty-third Day of August, 2016

Michelle K. Lee

Michelle K. Lee
*Director of the United States Patent and Trademark Office*